US007147220B2

(12) United States Patent
Takeuchi

(10) Patent No.: US 7,147,220 B2
(45) Date of Patent: Dec. 12, 2006

(54) BANKNOTE MOVING APPARATUS

(75) Inventor: Toru Takeuchi, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 3 days.

(21) Appl. No.: 10/799,531

(22) Filed: Mar. 11, 2004

(65) Prior Publication Data

US 2004/0245709 A1 Dec. 9, 2004

(30) Foreign Application Priority Data

Mar. 12, 2003 (JP) ..... 2003-065843
Feb. 18, 2004 (JP) ..... 2004-042123

(51) Int. Cl.
*B65H 29/38* (2006.01)

(52) U.S. Cl. ..... 271/177; 271/180

(58) Field of Classification Search ..... 271/180, 271/181, 177, 176; 109/22, 23, 24, 45, 46, 109/47, 48, 53, 55
See application file for complete search history.

(56) References Cited

U.S. PATENT DOCUMENTS 5,344,135 A 9/1994 Isobe et al.
5,641,157 A * 6/1997 Mays et al. ..... 271/181
5,653,436 A * 8/1997 Zouzoulas ..... 271/177
5,676,366 A * 10/1997 Polidoro ..... 271/176
5,861,320 A * 1/1999 Shiraishi ..... 438/16
6,361,039 B1 * 3/2002 In 't Zandt et al. ..... 271/159
2003/0127790 A1 * 7/2003 Chou ..... 271/177

* cited by examiner

*Primary Examiner*—Patrick Mackey
*Assistant Examiner*—Thomas Morrison

(57) ABSTRACT

A banknote moving system including a banknote storing unit that can be removably positioned within a banknote receiving unit. The banknote storing unit has a storing section and receives a banknote from the banknote receiving unit. The mover unit can move between a standby position and a moved position to move the received banknote into the storing section of the storing unit. The mover driving unit operates the mover unit in a reciprocating manner between the standby position and the moved position. The rotating driving unit selectively operates the mover driving unit by applying a rotating force in either a clockwise or a counter clockwise direction. The standby position detecting unit produces a standby condition signal when the mover is in a standby condition, and the moved position detecting unit produces a moved position condition signal when the mover unit is in a moved position condition. Finally, the controlling unit receives the standby condition signal and the moved position condition signal and produces a driving direction command signal for selectively operating the rotating driving unit in either the clockwise direction or the counter clockwise direction.

11 Claims, 17 Drawing Sheets

BANKNOTE MOVING APPARATUS

CROSS-REFERENCE TO RELATED APPLICATION

This application is based on application number 2003-065843 filed in Japan, dated Mar. 12, 2003, and application number 2004-042123 filed in Japan, dated Feb. 18, 2004.

FIELD OF THE INVENTION

This invention is related to a banknote moving unit and more particularly to a compact, detachable banknote moving unit for moving a received banknote into a storing section.

DESCRIPTION OF RELATED ART

Banknote moving units for moving a banknote into a storing unit are known. For example, a moving unit is taught in the Japanese Utility Model 2558984 which corresponds to U.S. Pat. No. 5,344,135 more particularly in reference to FIGS. 3–5. The pusher for moving the banknote is attached at a parallel mechanical linkage, and a lever of the linkage is urged by a spring while the pusher member is kept in the standby position. When the banknote is moved into the storing section by the pusher member, a linkage attached to the pusher member is pulled by a wire which is located around a pulley. Therefore the pusher moves in the parallel, and also moves the banknote. When the banknote is moved into the storing section, the linkage is driven together with the spring force. This can be a disadvantage where the driving energy is large.

SUMMARY OF THE INVENTION

The present invention as defined in the claims is to provide a banknote moving unit in which the moving energy for the banknote is reduced while providing a banknote moving unit which is compact in size. To achieve these advantages, the present invention is as structured as follows. A banknote moving system includes a banknote storing unit, a mover unit, a mover driving unit, a rotating driving unit, a standby position detecting unit, a moved position detecting unit, and a controlling unit. The banknote storing unit can be removably positioned within a banknote receiving unit. The banknote storing unit has a storing section and receives a banknote from the banknote receiving unit.

The mover unit can move between a standby position and a moved position to move the received banknote into the storing section of the storing unit. The mover driving unit operates the mover unit in a reciprocating manner between the standby position and the moved position. The rotating driving unit selectively operates the mover driving unit by apply a rotating force in either a clockwise direction or a counter clockwise direction. The standby position detecting unit produces a standby condition signal when the mover is in a standby condition. Similarly, the moved position detecting unit produces a moved position condition signal when the mover unit is in a moved position condition. Finally, the controlling unit receives the standby condition signal and the moved position condition signal and produces a driving direction command signal for selectively operating the rotating driving unit in either the clockwise direction or the counter clockwise direction.

With this construction, the mover is moved by the rotating driving section of the banknote receiving station through the mover driving unit. Further, the mover moves towards the standby position based on one direction. Then the mover is detected at the standby position by the standby position detecting unit, the driving section is stopped by the controlling section. Accordingly, the mover remains in the standby position.

When the received banknote is moved into the storing section, the rotating driving unit rotates in the counter direction to the above-mentioned direction. Therefore the mover moves towards the storing section through the mover driving unit. When the mover goes in the moved position, it is detected by the moved position detecting unit. As a result, the driving section is stopped. Then the rotating driving unit rotates in the counter direction to above-mentioned direction. Therefore the mover moves towards the standby position, afterwards it is kept on the standby position.

Accordingly, the mover moves towards the moved position or the standby position by the normal rotation or the counter rotation of the driving section. Therefore the rotating driving unit is not overcome by the spring force. As a result, the driving electric power is reduced.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the intention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
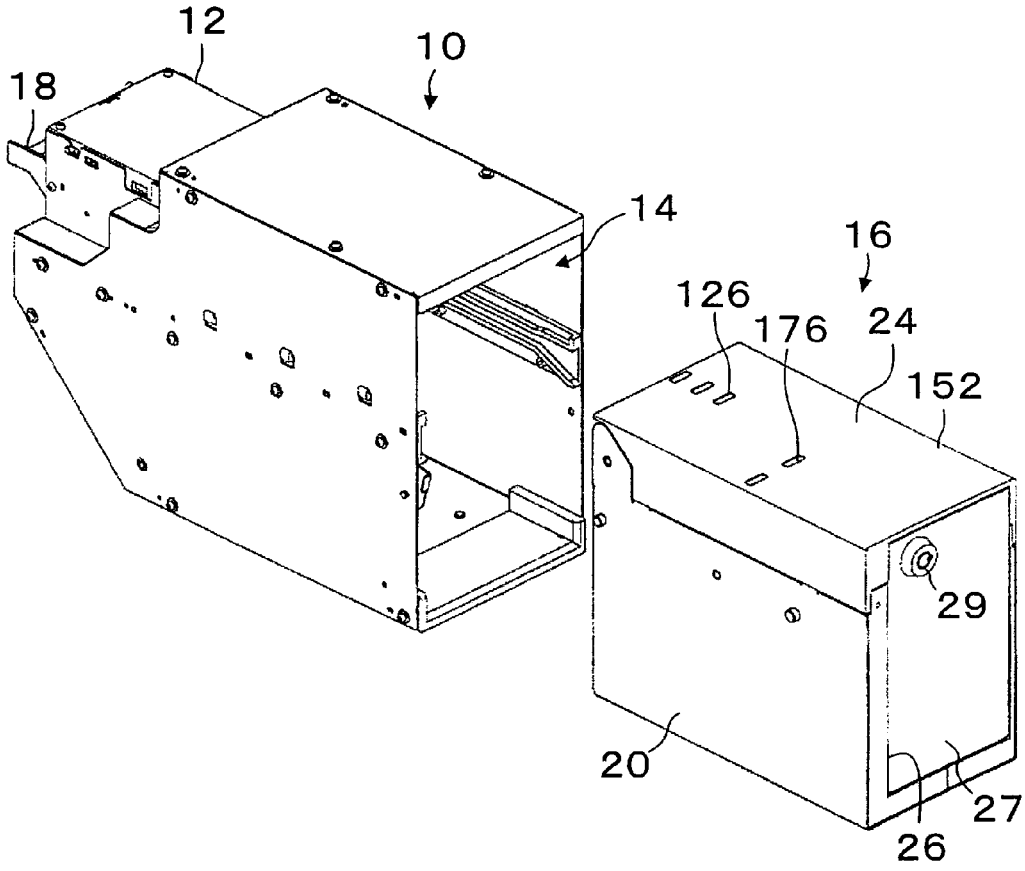
FIG. 1 is a perspective view of the banknote storing unit removed from the banknote receiving unit in accordance with an embodiment of the present invention.

In reference to FIG. 1, the banknote receiving unit 10 includes a banknote accepting unit 12 that is located at the front upper section, and a banknote storing unit 16 that can be inserted into a safe space 14 that is located within the banknote receiving unit 10 and adjacent to the banknote accepting unit 12. The banknote storing unit 16 is secured by a locking unit (not shown). The banknote receiving unit 10 can be positioned within a vending machine, an exchanging machine, or some other machine that receives banknotes from a user. Typically, only the banknote guide 18 of the banknote accepting unit 12 is accessible by a user from the exterior of the machine where a user can insert a banknote BN. The banknote storing unit 16 can refer generally to any enclosed unit for removably inserting into a receiving unit such as the banknote receiving unit 10.

Figure 5:
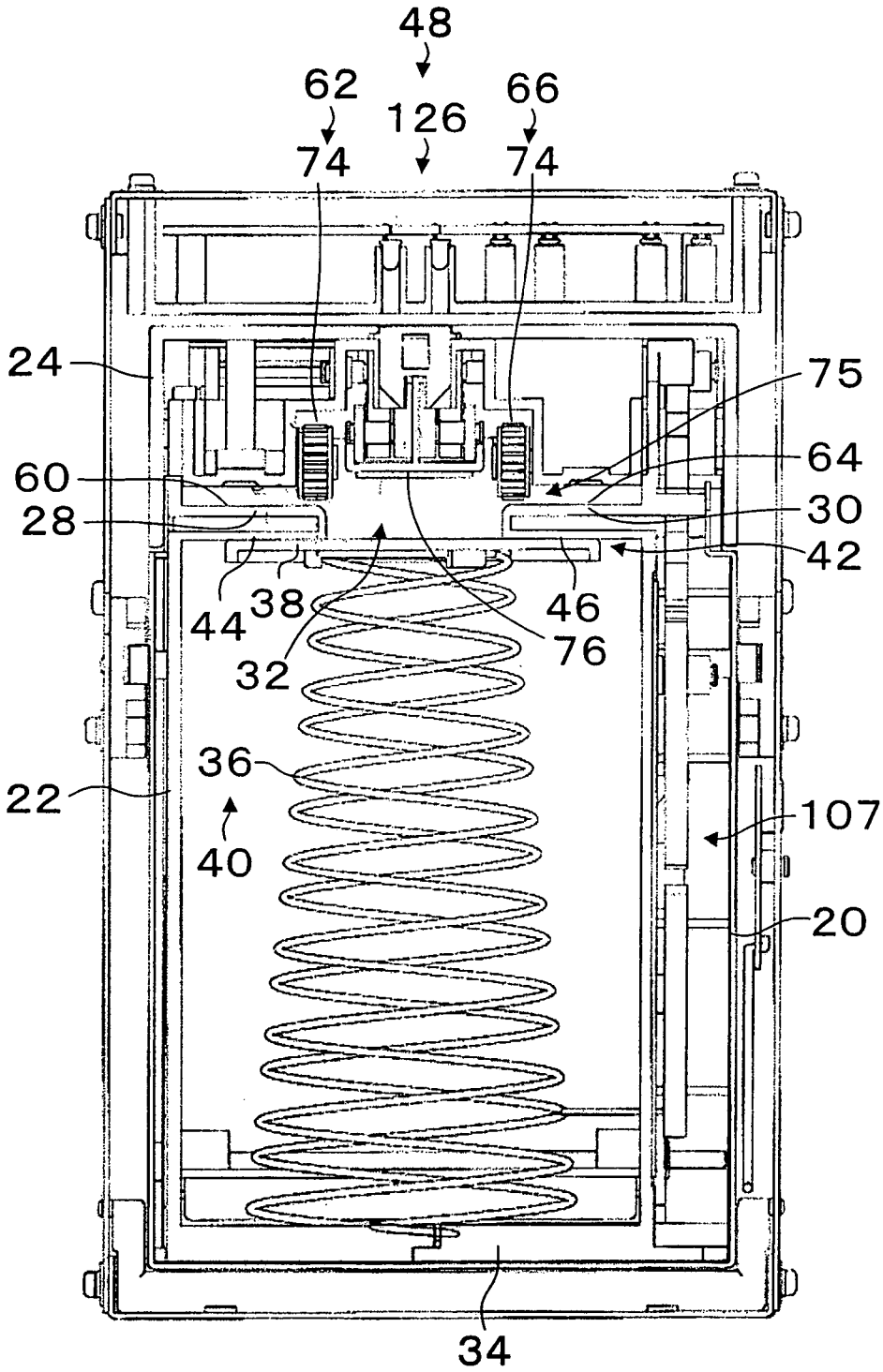
FIG. 5 is a cross sectional view showing the banknote transporting unit in accordance with an embodiment of the present invention.

As shown in FIGS. 1 and 5, the banknote storing unit 16 includes a frame 20 that is typically formed out of sheet metal and is box-like in shape, a storing box 22 that is typically formed from a resinous material, and a storing unit box 24 that is typically formed from a resinous material and is located on the storing unit 16. The storing box 22 fits within the frame 20. The banknote storing unit 16 is generally shaped as an elongated cube.

Next the structure of the storing box 22 is explained (as is mainly shown in FIG. 5). The storing box 22 has an opening at rear side wall 26, the left top board 28 protrudes towards the center from the left side wall, a right top board 30 protrudes towards the center from the right side wall and made up of a pushing passageway 32 which extends towards the moving direction and is located between the top boards 28 and 30. A banknote supporting unit 40 is located in the storing box 22 that includes a pair of springs 36 which are fixed at the bottom wall 34 in the storing box 22 and supporting board 38 which is fixed at the upper ends of the springs 36. The banknote storing section 42 is enclosed by supporting board 38, lower surface 44 of left top board 28 and lower surface 46 of right top board 30. The opening of a rear side wall 26 is closed by a lid 27 where the lower section can pivot at the storing box 22 and is locked at storing unit box 24 by locking unit 29.

Figure 4:
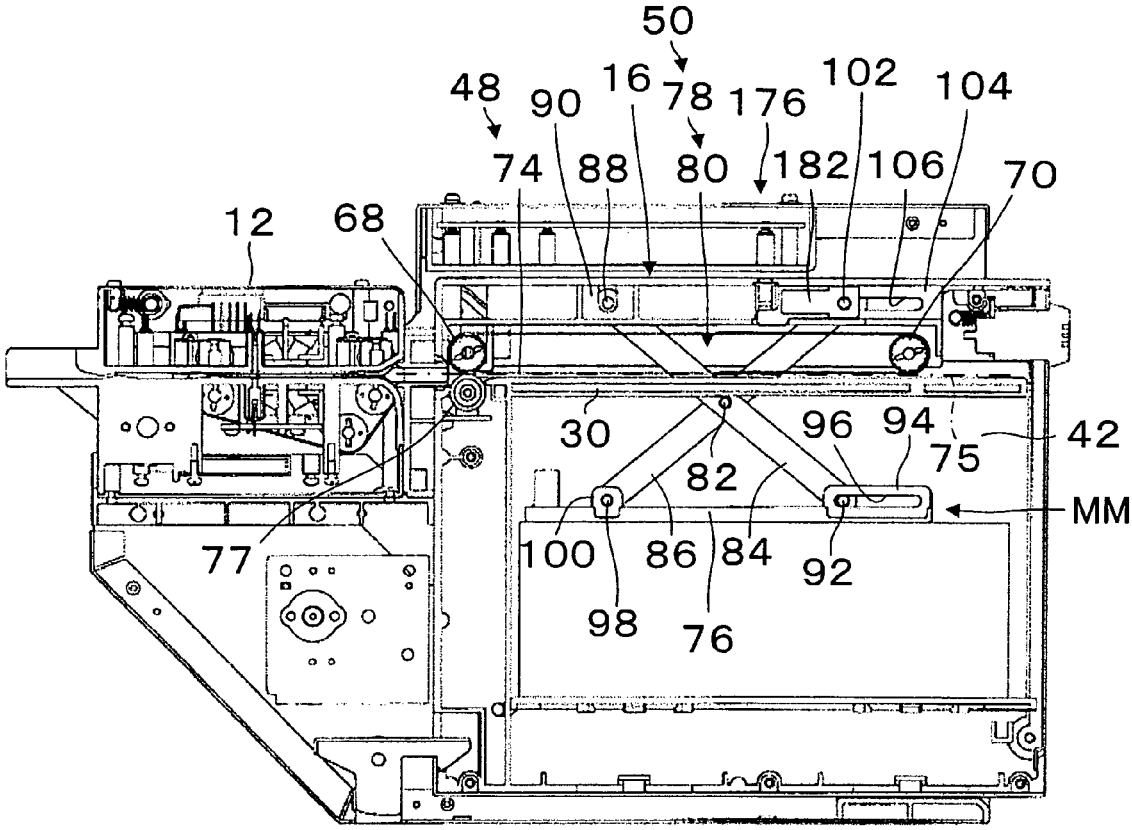
FIG. 4 is a cross sectional view showing the pusher in an activated condition by the banknote moving unit in accordance with an embodiment of the present invention.

Next the structure of the storing unit box 24 is explained (As is mainly shown in FIG. 4). The banknote transporting unit 48 and banknote moving unit 50 are built in storing unit box 24. The downward slanting surface 54 faces to exit 52 of banknote accepting unit 12 and make up of banknote entry 58 together with upward slanting surface 56 of the side of storing box 22. The banknote entry 58 is horn like in shape.

In reference to FIG. 5, the banknote transporting unit 48 is described. The banknote transporting unit 48 includes a left belt unit 62 which faces to a left upper surface 60 of left top board 28 and a right belt unit 66 which faces to right upper surface 64 of right top board 30.

Since a left and right belt unit 62 and 66 are similar in structure, the right belt unit 66 is explained for convenience. A timing belt 74 is put around between a timing pulley 68 which is located relatively to a banknote entry 58 and a timing pulley 70 which is located at the side of lid 27. The under surface of timing belt 74 is located away from the right upper surface 64 at a distance corresponding to the thickness of a banknote. The timing pulley 68 is driving by the motor of banknote accepting unit 12 and rotates in the counterclockwise direction as shown in FIG. 4. Timing belt 74 which is put around between pulley 68 and 70 have contact with right upper surface 64, because it can move away from the right upper surface 64.

The space which is enclosed the lower surface of the timing belt 74, a right upper surface 64 and a left upper surface 60 defines a banknote moving passageway 75. Holding roller 77 is located relative to timing pulley 68 at upward slanting surface 56 of storing box 22, and the surface resiliently has contact with timing belt 74. Accordingly, the banknote which is transported from exit 52 is held between the lower surface of timing belt 74 and holding roller 77 and is drawn into the inside of banknote storing unit 16, and is transported by the friction of the under surface of belt 74 at the same time, it is guided by right upper surface 64 and left upper surface 60. Therefore, the banknote transporting unit 48 is a frictional transporting unit that has a function which guides the banknote along left top board 28 and right top board 30. The banknote transporting unit 48 can be changed to another type of transport unit that has the same function.

Figure 3:
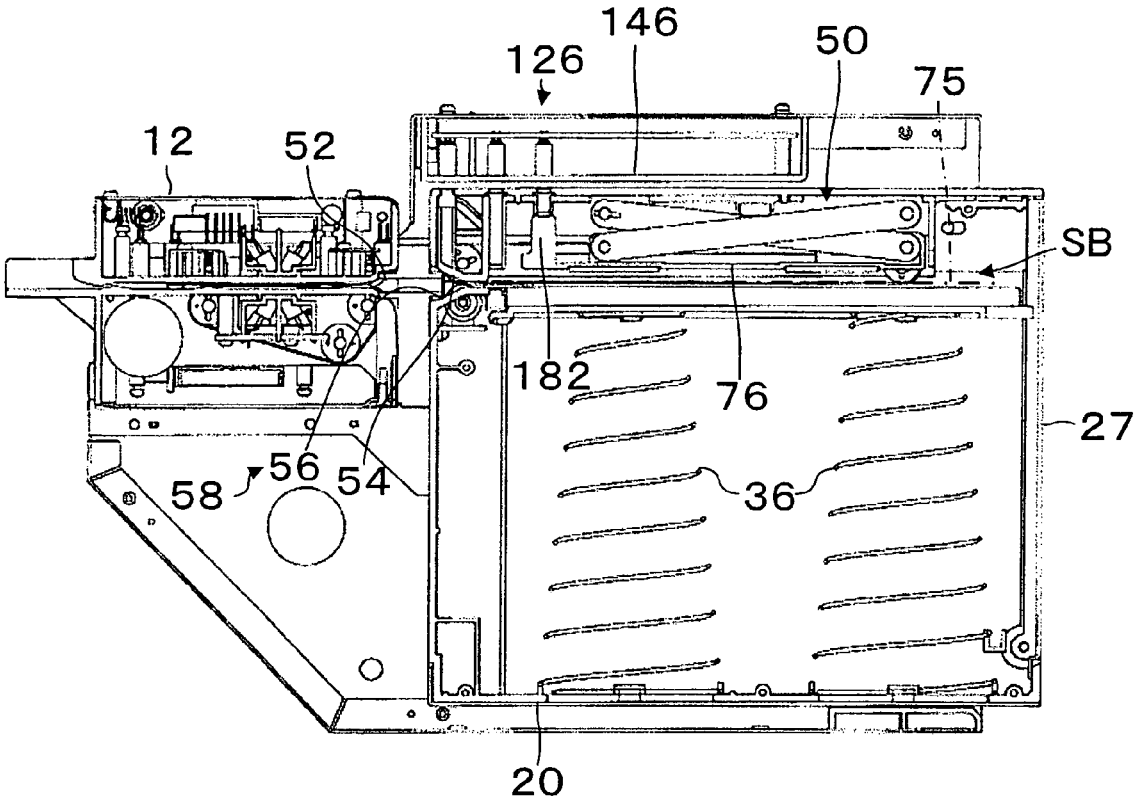
FIG. 3 is a cross sectional view showing the banknote storing unit inserted into the banknote receiving unit in accordance with an embodiment of the present invention.

As shown in FIGS. 3–4, the bank note moving unit 50 is described. A moving unit 50 includes a pusher member 76 which is a plate and is for moving the banknote placed adjacent to the plate. A motor driving unit 78 and a parallel transporting unit 80 has a function which moves the pusher member 76 at a predetermined stroke and in a parallel motion. Therefore, the pusher member 76 linearly reciprocates into and out of the storing section 42. That is, the pusher member 76 moves in a line directed into and out of the storing section 42. A converting driving unit 81 converts from the rotation of the rotating driving unit 116 to a pivotable motion. In one embodiment, the banknote transporting unit 48 permits a sliding release of the banknote as the banknote is pushed into the storing section.

The parallel transporting unit 80 includes a first link 84 and a second link 86 which are the same length and are joined by shaft 82. The first link 84 and the second link 86 are the same length and can pivot on the shaft 82 near their midpoints. Pivoting shaft 88 is fixed at the upper section of the first link 84 and is pivoted at a bearing 90 which is located at the reverse surface of storing unit box 24. The shaft 92 is located at the lower section of the first link 84 and is inserted into the first guiding groove 96 which is located at the first guiding board 94 which is fixed at the upper surface of the pushing member 76 and is slidable in a groove 96. Therefore the first link 84 is a pivotable lever.

A first guiding groove 96 extends parallel to the pusher member 76. The shaft 98 is fixed at the lower section of the second link 86 and is pivotable at a bearing 100 which is fixed at the upper surface of the pushing member 76. The shaft 102 is fixed at the upper section of a second link 86 and is slidable in a guiding hole 106 of a second guiding board 104 which is located at the under surface of the storing unit box 24. Therefore when shaft 88 pivots, the pushing member 76 is moved alternately upwards and downwards. When the driving source of the parallel transporting unit 80 is pivoting shaft 88, a rotating board is not used. Accordingly, the height of the storing unit box 24 is reduced. As a result, the banknote storing box 16 becomes smaller.

Figure 2:
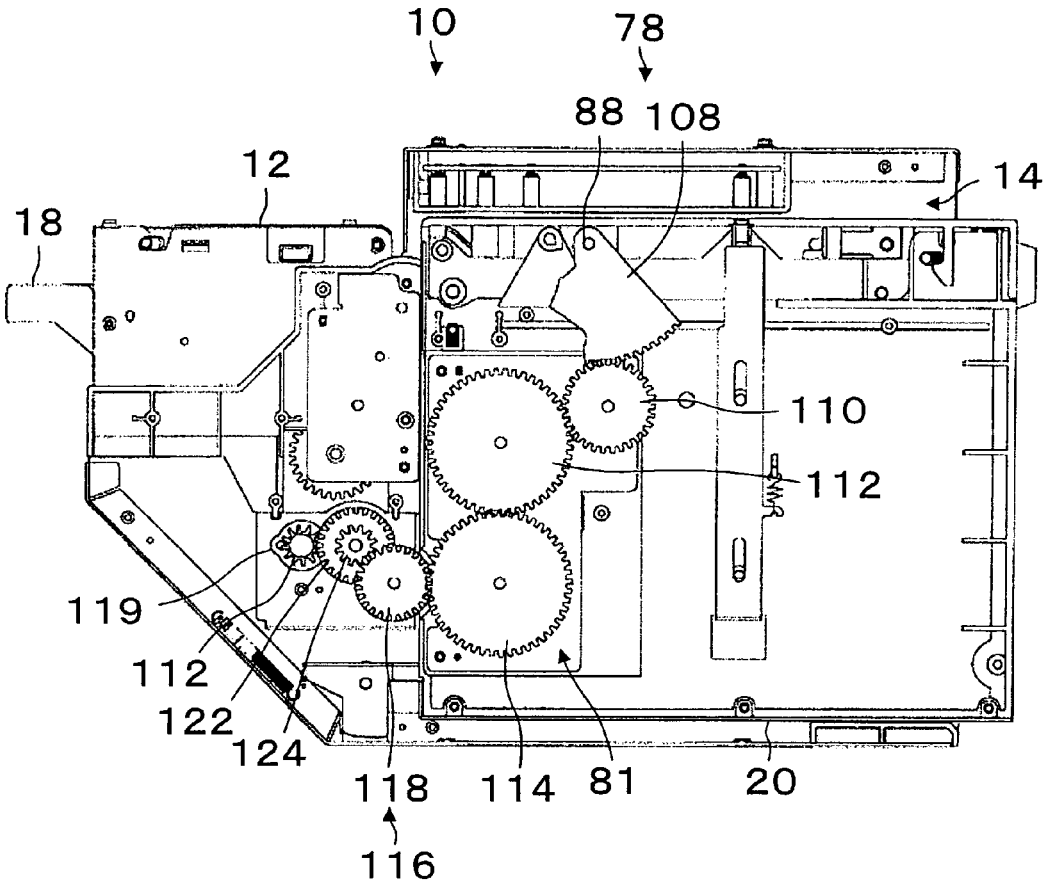
FIG. 2 is a cross sectional view of the driving unit for the banknote moving unit in accordance with an embodiment of the present invention.

In reference to FIG. 2, the converting driving unit 81 described. The converting driving unit 81 is located at the driving space 107 which is located between the frame 20 and the storing box. A sector gear 108 is fixed at the left end section of the pivoting shaft 88 and engages with a gear 110. The gear 110 is operatively connected with gear 118 which is rotating driving unit 116 of banknote receiving unit 10 through gears 112 and 114. Gears 110, 112 and 114 are attached at the side wall of storing box 22 and are rotatable. Therefore, the converting driving unit 81 has a function where the rotation of the rotating driving unit 116 is converted into the pivoting motion of the pivoting shaft 88. Accordingly, the converting driving unit 81 can be changed to another type of mechanism which has the same function. When the converting driving unit 81 is located beside the storing box 22, as in this embodiment, the height of banknote storing unit 16 can be reduced which leads to a more compact construction.

The gear 118 of the rotating driving unit 116 is driven by a driving gear 112 which is fixed at the output shaft of the driving motor 119 through gears 112 and 124. In other words, when the sector gear 108 pivots in the counterclockwise direction based on the counterclockwise direction of driving gear 112, the pushing member 76 moves to the standby position SB. When the pushing member 76 is located at the standby position SB, the lower surface is located at the opposite of banknote storing section 42 rather than banknote moving passageway 75. In other words, the under surface is located over banknote moving passageway 75.

When the sector gear 108 pivots in the clockwise direction, the pushing member 76 crosses a banknote moving passageway 75, and moves linearly into the banknote storing section 42 through a pushing passageway 32, and pushes the supporting board 38 to a predetermined, moved position MM through the banknote. Therefore the banknote which is located at banknote moving passageway 75 passes through the pushing passageway 32, the banknote being deformed into a U-shape, afterwards the banknote goes into the banknote storing section 42. The pushing passageway 32 is more narrow than the width of a banknote. As the banknote is pushed through the narrow pushing passageway 32, the lengthwise edges of the banknote are bended or folded into the U-shape around the pushing member 76. Once the banknote is pushed past the restricted opening of the pushing passageway 32, the bended or folded edges then unfold making the banknote cross section wider than the restricted opening of the pushing passageway 32. When the pushing member 76 withdraws from the banknote storing section 42, the unfolded banknote is then held between under surfaces 44, 46 and supporting board 38. In other words, the banknotes are retained in a stacked position.

Figure 6:
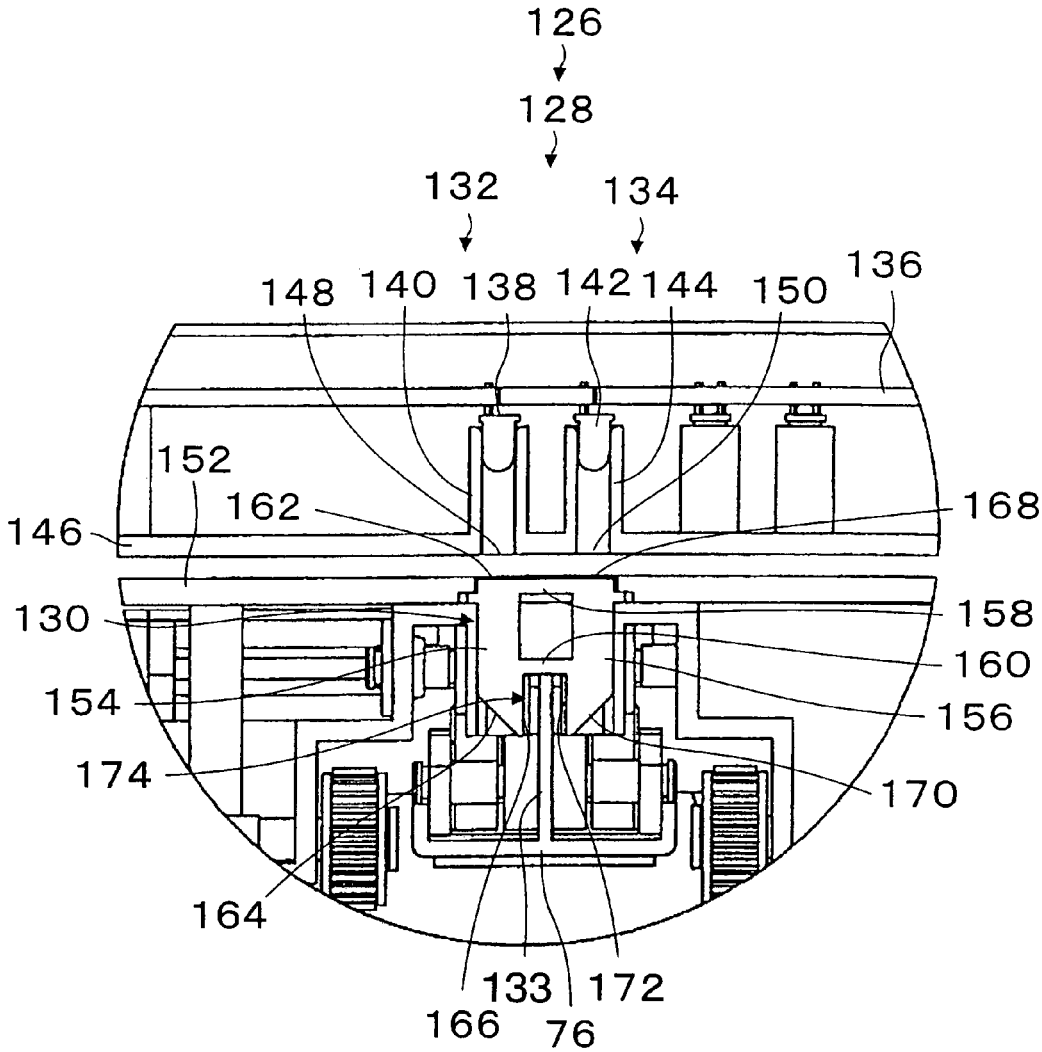
FIG. 6 is a cross sectional view showing the standby detecting unit in accordance with an embodiment of the present invention.

In reference to FIG. 6, the standby position detecting unit 126 of the banknote moving unit 50 is described. The standby position detecting unit 126 includes a standby projecting and receiving section 128, a standby guiding section 130 and a standby detecting piece 133. The standby projecting and receiving section 128 includes a projecting section 132 and a receiving section 134 and is fixed at the upper inner surface of the safe space 14 of the banknote receiving unit 10. The projecting section 132 and the receiving section 128 are located at base board 136 downwards and are disposed at a small distance away from each other.

The projecting section 132 includes an emitting element 138; for example a light-emitting diode (LED), etc., while the receiving section 134 includes a photo acceptance or detecting unit 142; which is for example a phototransistor etc., and a cylinder 144. Emitting element 138 of projecting section 132 is inserted into cylinder 140. Photo acceptance element 142 of receiving section 134 is inserted into cylinder 144. The projecting and receiving section 128 comprises an optical emitter-receiver pair unit that is used as a standby position detecting unit for producing a standby condition detecting signal when the pushing member 76 is in a standby condition.

The emitting element 138 is inserted into the upper section of cylinder 140 which extends upwards and perpendicular from the cover 146 which is located below the base board 136. Also the position is located over lower opening 148 at approximately two times the size of the diameter of cylinder 140. The lower opening 148 of the cylinder 140 is located just above the projecting surface 162. Similarly, the Photo acceptance element 142 is inserted into cylinder 144. When the emitting element 138 and the photo acceptance element 142 are located at the upper sections of cylinders (140, 144) and are located above lower openings (148, 150) at a diameter of the cylinders (140, 144), a rising air current does not occur in the cylinders, because the upper openings are closed by elements (138, 142).

Consequently, when dust enters the safe space 14, a rising air current containing dust particles does not approach either the emitting element 138 or the photo acceptance element 142. As a result, the dust does not adhere on emitting element 138 or photo acceptance element 142. When the rising air current slightly occurs, the current does not enter beyond the diameter of the cylinder. Therefore dust does not adhere to the emitting element 138 is reflected by the wall of the cylinder 140 as a guide. The emitted light from projecting section 132 is reflected by the wall of cylinder 144 and is guided. As a result, the diffusion of the light is inhibited. However cylinders 140 and 144 are not an essential component at the projecting section 132 and the receiving section 134.

A standby optical guide unit 130 faces toward the projecting and receiving section 128 and can be fixed at the underside of the top board 152 of the banknote storing unit 16 by a bracket (not shown). The standby optical guide unit 130 includes an emitting optical guide 154 which extends perpendicular to the right, below projecting section 132 and receiving optical guide 156 which extends perpendicular to the right below receiving section 134. The emitting optical guide 154 and the receiving optical guide 156 are connected by stays 158 and 160 at the upper section and the middle section, and are gate-like in shape. When the emitting optical guide 154 and the receiving optical guide 156 are unified, the number of parts are reduced. Accordingly the assembling and the cost are reduced. Alternatively, the emitting optical guide 154 and the receiving optical guide 156 can be separated.

The upper surface of the emitting optical guide 154 is a receiving surface 162, and a reflecting surface 164 which is located at the lower end and slants to the extent line of receiving surface 162 at 45 degrees, and the side surface is detecting projecting surface 166. The upper surface of receiving optical guide 156 is receiving surface 168, and reflecting surface 170 which is located at the lower end and slants to the end line of the receiving surface 168 at a 45 degree angle, and the side surface is the detecting receiving surface 172. The reflecting surface 164 and the reflecting surface 170 are located face to face. The detecting projecting surface 166 and the detecting receiving surface 172 are parallel and extend perpendicularly with a gap to construct a detecting space 174.

As a consequence, the light which is emitted from the emitting element 138 enters the projecting optical guide 154 through the receiving surface 162. After this, the light in the projecting optical guide 154 is reflected by a reflecting surface 164 to the side. Once reflected by the reflecting surface to the side, the reflected light crosses the detecting space 174 from the detecting projecting surface 166 and enters the receiving optical guide 156 through the detecting receiving surface 172, assuming the path between the detecting projecting surface 166 and the detecting receiving surface 172 is not blocked with an obstruction. The light in the receiving optical guide 156 is reflected by the reflecting surface 170 upwards and strikes the photo acceptance element 142 through the projecting surface 168.

The standby detecting pieces 133 is fixed at the upper surface of the side of the banknote accepting unit 12 resides on the pushing member 76. When the pushing member 76 is located at the standby position SB, the standby detecting piece 133 is located at the detecting space 174, and obstructs the flow of light between the detecting projecting surface 166 and the detecting receiving surface 172. Therefore when the photo acceptance element 142 does not detect the light from the emitting element 138, this indicates the pushing member 76 is detected to be in the standby position SB. When the pushing member 76 is detected at the standby position SB, the motor 119 is stopped which causes the driving gear 112 to also stop, and the pushing member 76 is kept at the standby position SB.

Figure 7:
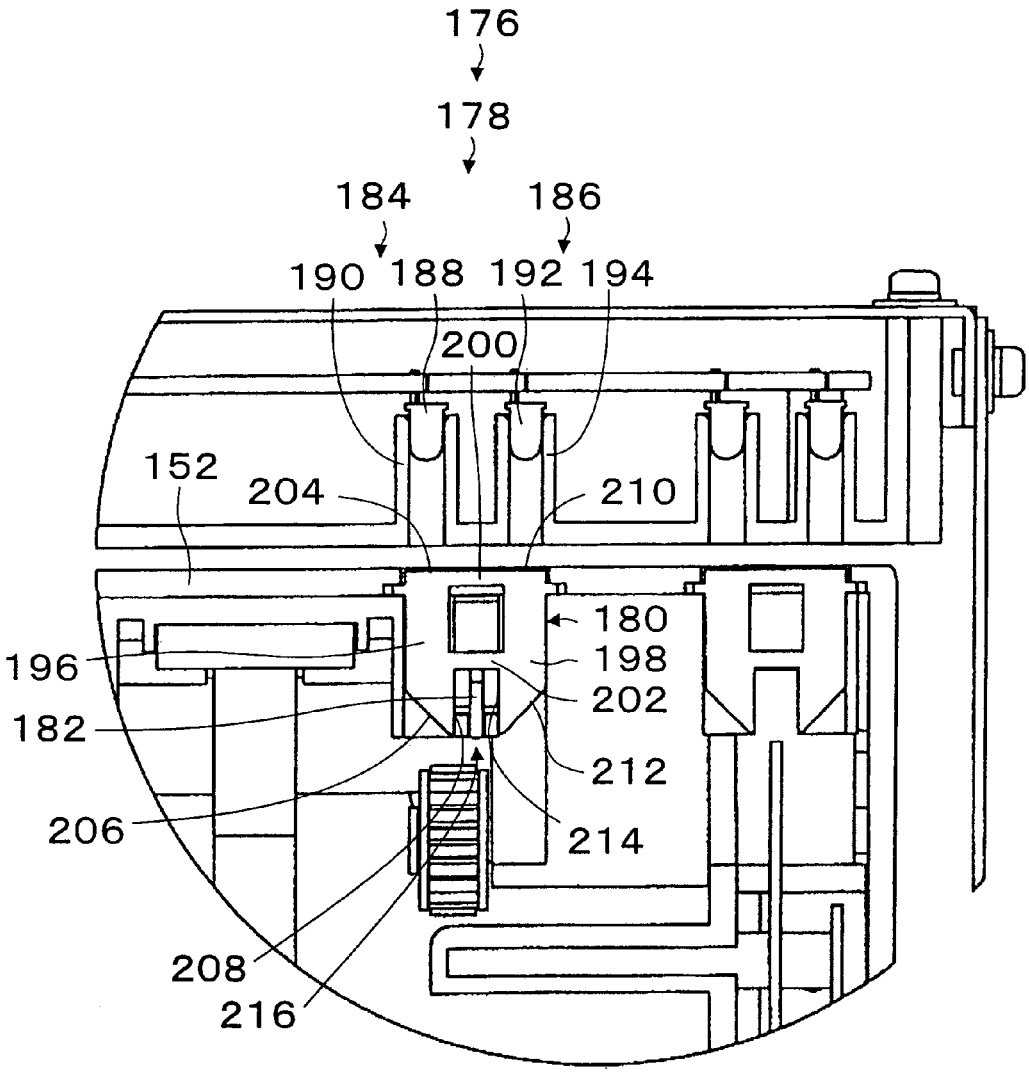
FIG. 7 is a cross sectional view of the moving position detecting unit in accordance with an embodiment of the present invention.

In reference to FIGS. 4 and 7, the moving position detecting unit 176 is described. The moving position detecting unit 176 includes a moving projecting and receiving section 178, a moving optical guide 180, and a moving detecting piece 182. The moving projecting and receiving section 178 includes a projecting section 184 and a receiving section 186. The emitting element 184 is inserted into a cylinder 190 at the projecting section 184. The photo acceptance element 192 is inserted into the cylinder 194 at the receiving section 186. Both structures of the projecting section 184 and the receiving section 186 are similar to both the projecting section 132 and the receiving section 134 of the standby position detecting unit 126. The projecting and receiving section 178 comprises an optical emitter-receiver pair unit that is used as a mover position detecting unit for producing a mover position condition detecting signal when the pushing member 76 is in a standby condition.

The moving optical guide 180 is fixed at the underside of the top board 152 by a bracket (not shown) and faces to a moving projecting and receiving section 178. The moving optical guide 180 includes a projecting optical guide 196 which extend perpendicular right under a projecting section 184 and a receiving optical guide 198 which extents perpendicular right under a receiving section 186. The projecting optical guide 196 is joined with the receiving optical guide 198 and are connected by stays (200, 202), and it is gate-like in shape. When the emitting optical guide 196 and the receiving optical guide 198 are unified, the number of parts is reduced. Accordingly the assembling time and the cost are reduced. Alternatively, the emitting optical guide 196 and the receiving optical guide 198 can be separated.

The upper surface of the emitting optical guide 198 is a receiving surface 204, and a reflecting surface 206 is located at the upper end and slants to the end line of a receiving surface 204 at a 45 degree angle, and the side surface is a detecting projecting surface 208. The upper surface of the receiving optical guide 198 is a projecting surface 210, and a reflecting surface 212 is located at the lower end and slants to the end line of the receiving surface 210 at a 45 degree angle, and the side surface is a detecting receiving surface 214.

The detecting projecting surface 208 and the detecting receiving surface 214 are parallel to each other and extend perpendicularly with a gap that defines a detecting space 216. The reflecting surface 206 and the reflecting surface 212 are located facing each other. Therefore, the light which is emitted from the emitting element 188 enters the projecting optical guide 196 through the receiving surface 204. After this, the light is reflected by a reflecting surface 206 to the side after which it crosses the detecting space 216 from the detecting projecting surface 208. Once the light enters into the receiving optical guide 198 through the detecting receiving surface 214, the light in the receiving optical guide 198 is reflected by the reflecting surface 212 upwards where some portion of the light from the emitter eventually strikes the photo acceptance element 192 through projecting surface 210 and is detected.

The moving detecting piece 182 is fixed at a shaft 102 of the mover driving unit 78, and is moved in a body together with the pushing member 76. The mover driving unit 78 includes a plurality of mover driving unit gears for conducting rotational force between the rotating driving unit and the mover unit when the banknote storing unit is positioned within the banknote receiving unit. When the pushing member 76 is located at any end position (top, bottom or right), the moving detecting piece 182 is located at a detecting space 216, and cuts off the light. Therefore when the photo acceptance element 192 does not receive the light, the pushing member 76 is determined to be in the moved position MM. When the pushing member 76 is detected at the moved position MM, the motor is halted. In other words, the driving gear 112 is stopped from rotating in the clockwise direction, afterwards the driving gear 112 is rotated in the counter clockwise direction. Therefore the pushing member 76 moves from the moved position to the standby position SB.

Figure 8:
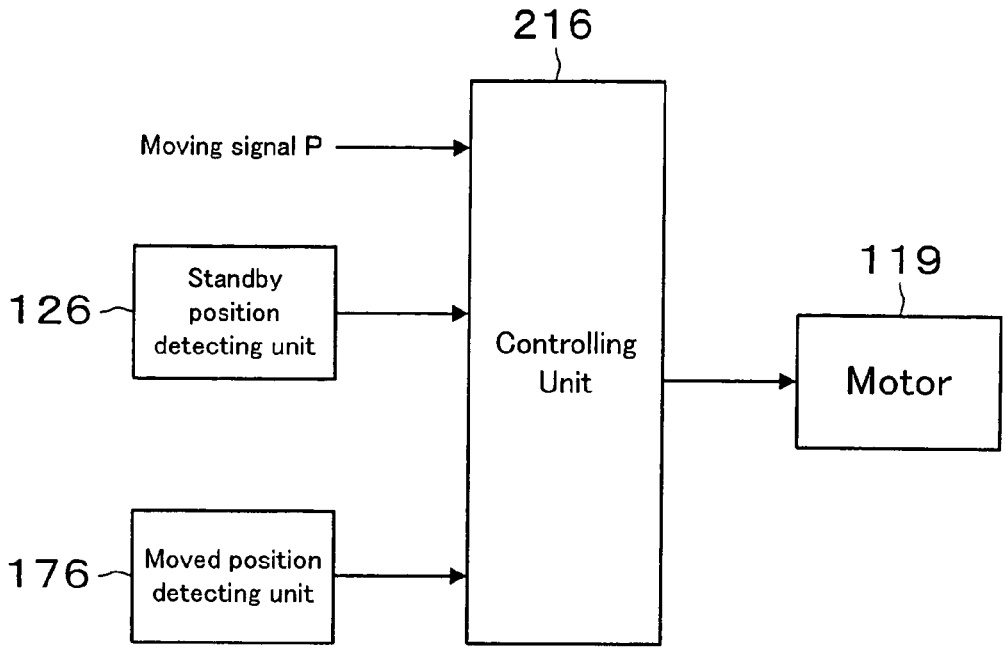
FIG. 8 is a block diagram of the controlling unit in accordance with an embodiment of the present invention.

In reference to FIG. 8, the controlling unit 216 is described. The controlling unit 216 operates the driving motor 119 in the forward rotation direction or the reverse rotation direction based on a moving signal P, a detecting signal from the standby position detecting unit 126, and a moving position detecting unit 176. The controlling unit 216 can be implemented as a suitably programmed microprocessor, for example.

Figure 9:
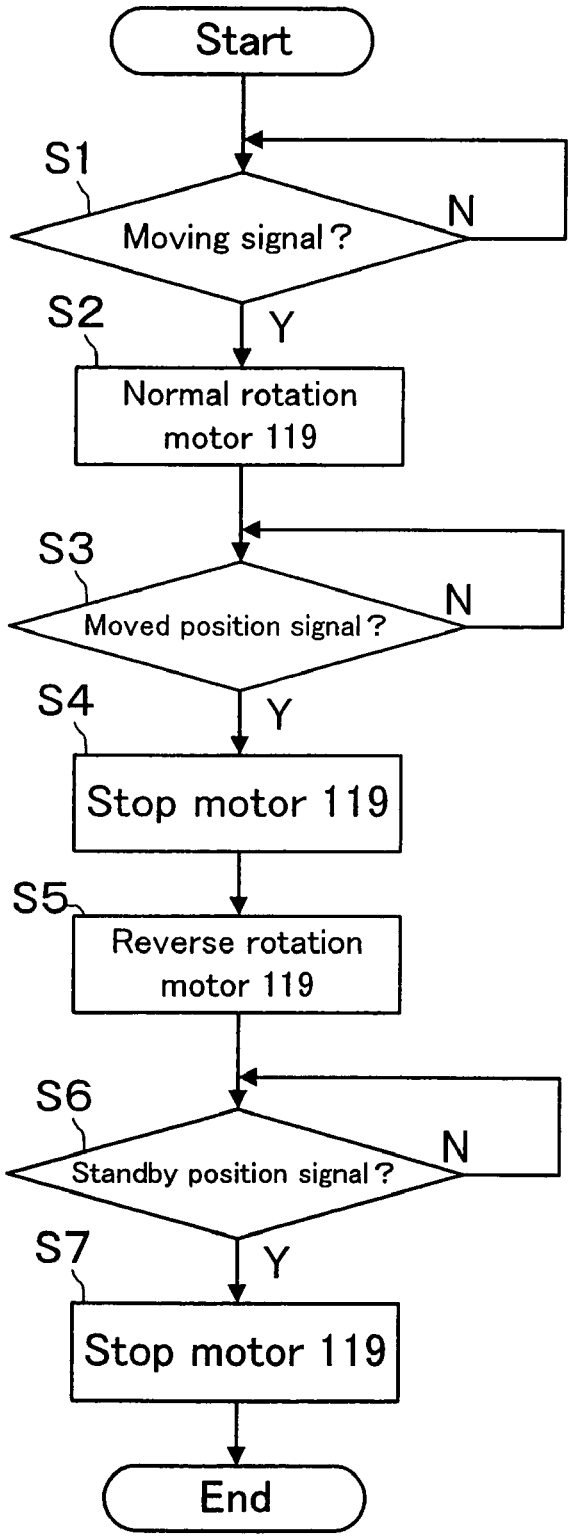
FIG. 9 is a flow diagram showing the operating of the controlling unit in accordance with an embodiment of the present invention.

In reference to FIG. 9, the operation of this operation of the controlling unit 216 is described according to a flow diagram. In the standby condition, the pushing member 76 is kept in a standby position SB, and a standby detecting piece 133 is located in the detecting space 174, while a moving detecting piece 182 is located outside the detecting space 216.

At step S1, the controlling unit 216 waits until the moving signal P is detected. Once the moving signal P is detected, control flow of the program moves to step S2.

At step S2, the driving motor 119 rotates in the forward direction. The controlling unit 216 produces a driving direction command signal for selectively operating the rotating driving unit 116 in a clockwise direction. Therefore the driving gear 112 rotates in a clockwise direction as shown in FIG. 2, and the control flow moves to step S3.

Within step S2, the converting driving unit 81 of the banknote storing unit is driving by the rotation of driving gear 112 through the rotating driving unit 116. The section gear 108 pivots in the clockwise direction through gears 114, 112 and 110. Therefore the pivoting shaft 88 pivots in the same direction. The first link 84 pivots in the clockwise direction as shown in FIG. 4 by the pivoting motion. Accordingly, shaft 92 slides to the left in the first guiding groove 96. When the pushing member 76 is moved in a downward direction, the second link 86 pivots in a counter clockwise direction at shaft 98 and shaft 102 slides to the left in the second guiding groove 106 as shown in FIG. 4.

The pushing member 76 crosses the banknote moving passageway 75, and moves in a parallel manner from a standby position SB into the banknote storing section 42 through the passageway 32 as shown in FIG. 4. In this way, a banknote which is located at banknote moving passageway 75 is pushed into banknote storing section 42. When the moving detecting piece 182 moves into a moving detecting space 216 by the movement of shaft 102, the emitting light from emitting element 138 is cut off by the moving detecting piece 182. Therefore the moving detecting unit 176 outputs a moving position signal, because photo acceptance element 192 does not receive the light from the emitting element 138.

At step S3, the controlling unit 216 waits until the moved position condition signal is received, then the motor 119 is halted at step S4, and control flow moves to step S5.

At step S5, the motor 119 rotates in the reverse direction causing the driving gear 118 to rotate in the counter clockwise direction. The controlling unit 216 produces a driving direction command signal for selectively operating the rotating driving unit 116 in a counter clockwise direction. This causes the sector gear 108 to pivot in the same direction causing the pushing member 76 to move upwards towards the standby position SB. The standby detecting piece 133 is then moved into the standby detecting space 174 based on this movement which then blocks the light is emitted from detecting projecting surface 166. Therefore, the photo acceptance element 142 outputs a standby position signal, because it does not receive light from the emitting element 138.

At step S6, the controlling unit 216 waits until the standby condition signal is received, then the program control flow moves to step S7 where motor 119 is again halted. Therefore, the pushing member 76 remains in the standby position SB until the next activation cycle.

In another embodiment, the like reference numbers corresponding to like parts. In reference to FIGS. 10–13, a banknote storing unit 316 includes a box-like frame 322 and can be constructed from sheet metal, a box-like frame cover 324 for covering the frame 322. In reference to FIGS. 12–13, the structure of the frame 322 is described.

A left side wall 328 and a right side wall 330 extend perpendicularly from both sides of a plate-like base 326. A left upper plate 332 and right upper plate 334 extend towards the inside from the left side wall 328 and the right side wall 330 and are parallel to base 326 with a space 336 in between the ends.

The interior space 338 is enclosed by the base 326, the side walls (328, 330) and the upper plates (332, 334). A banknote transporting unit 340 for receiving the banknote into the banknote storing unit 316, a mover unit 344 for moving the received banknote into the storing section 342, and a holding unit 346 for retaining the banknote within the storing section 342 are located in the interior space 338. The mover unit 344 is a mechanism for moving a banknote into the storing section 342 similar to the pushing member 76 of the first embodiment. A driving unit space 347 is located in the narrow region between the frame 322 and the cover 324. The driving unit 348 for operating the mover unit 344 is located in the driving unit space 347.

Figure 13:
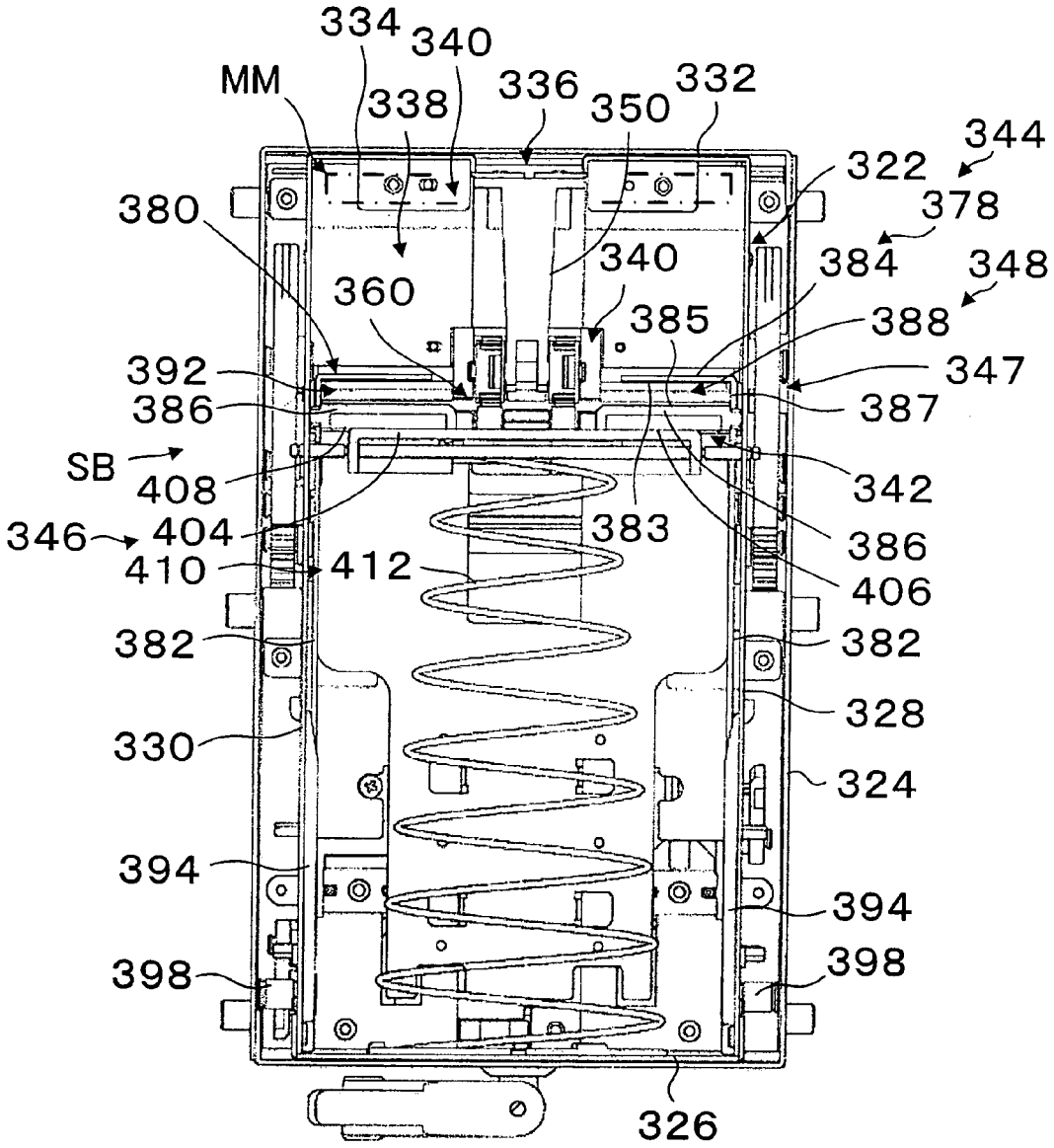
FIG. 13 is a cross sectional view of the banknote storing unit in accordance with an embodiment of the present invention.
Figure 14:
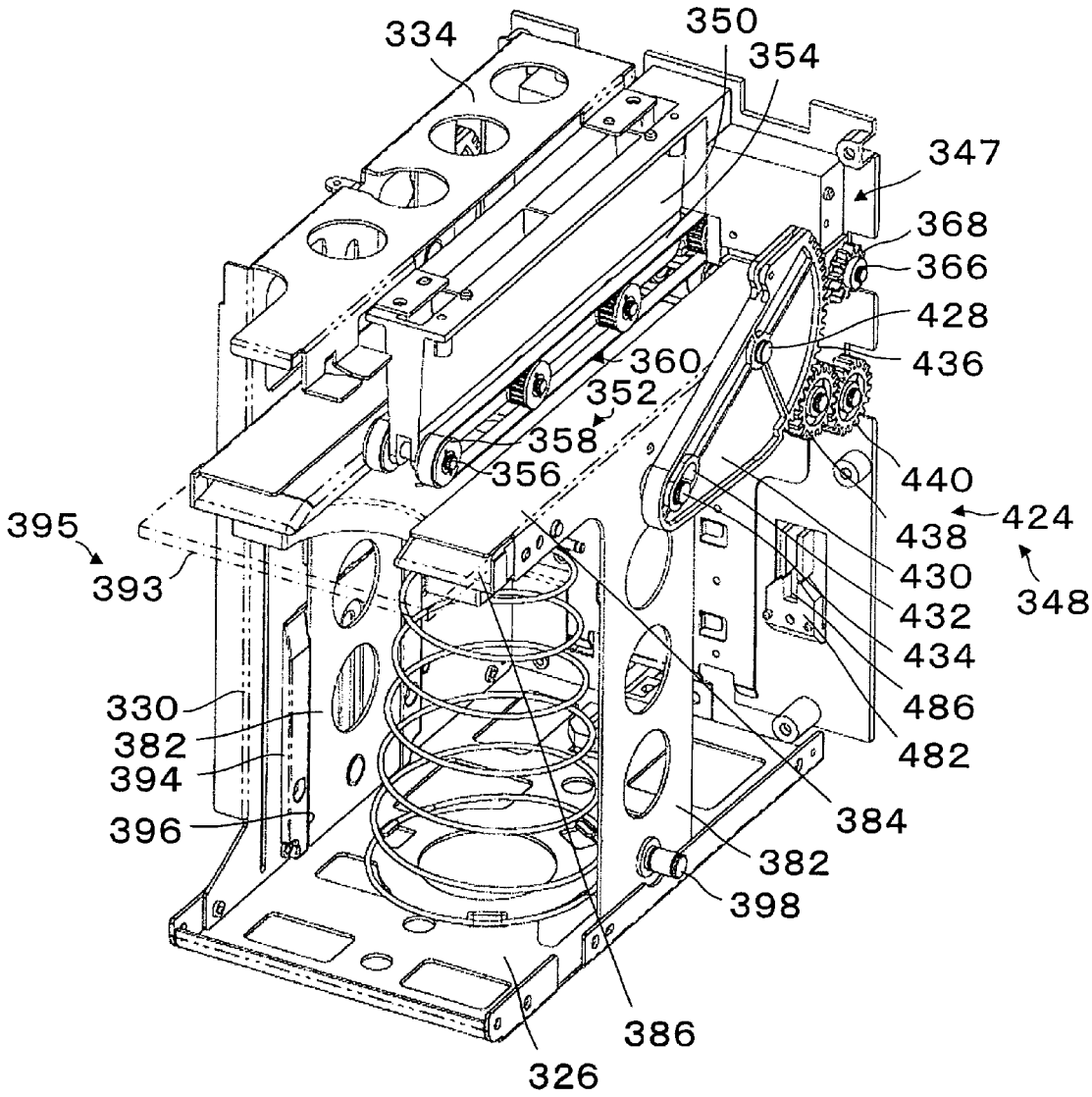
FIG. 14 is an inside perspective view of the banknote storing unit in accordance with an embodiment of the present invention.

In reference to FIGS. 13–14, the transporting unit 340 is described. An end section of support member 350 which is rectangular and fixed at the left upper plate 332 and the right upper plate 334 in the space 336. The other end of the support member 350 extends towards the storing section 342 where the banknote transporting unit 340 is attached.

The banknote transporting unit 340 includes a pulley unit 352 and a transporter 354. The pulley unit 352 includes a shaft 356 which is rotatably supported by the support member 350. On the shaft 356 is mounted a pulley 358 which has teeth for engaging the transporter 354. However the pulley 358 with teeth can be changed to a different type of pulley with a groove. A pulley unit 352 includes a plurality of pulleys 358 along the support member 350. This particular embodiment includes four pulley units, but is not limited to only four pulley units.

Figure 12:
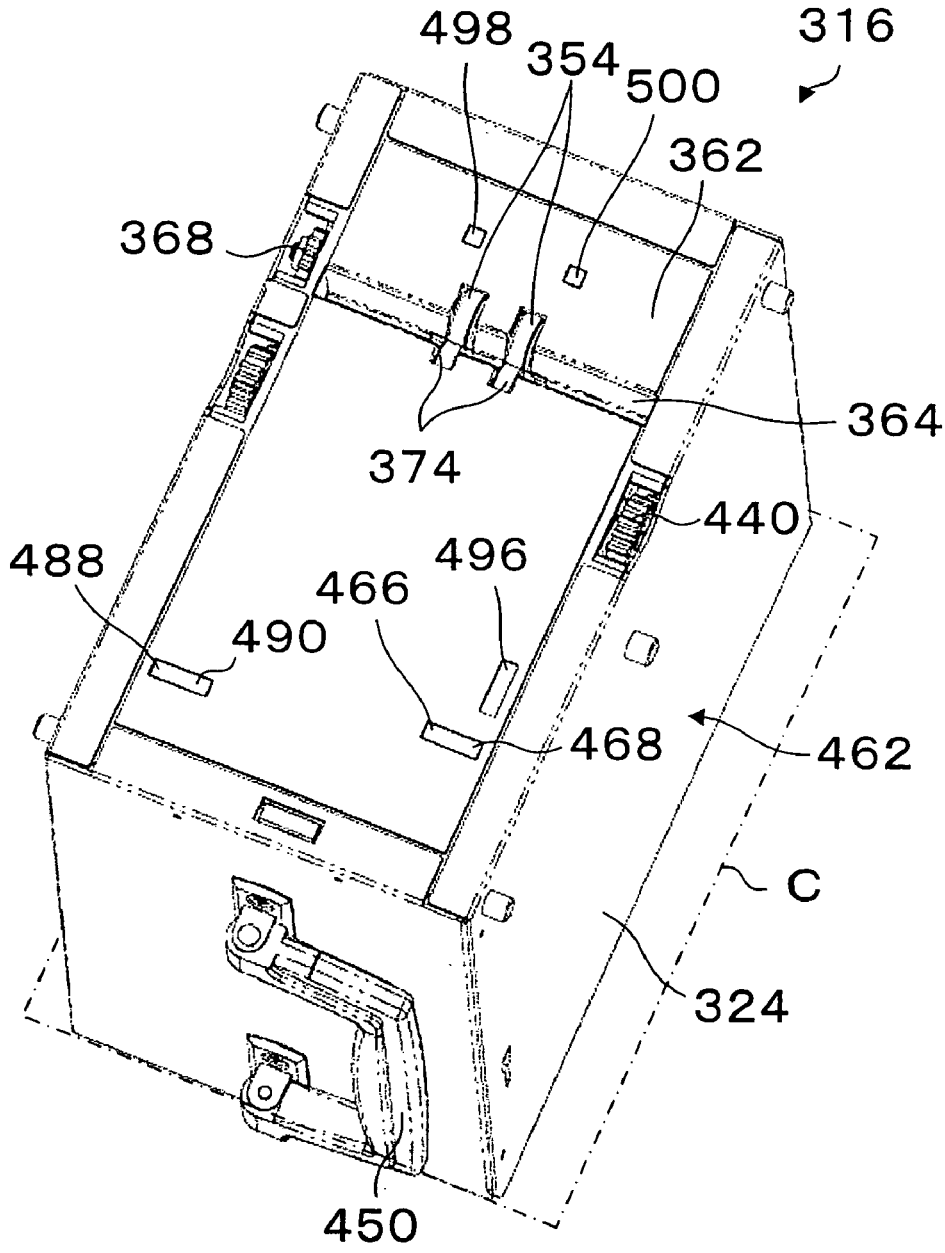
FIG. 12 is a perspective view of the banknote storing unit in accordance with an embodiment of the present invention.

The transporter 354 is wound around the pulleys 358 which are located at the ends of the support member 350. The pulleys 358 which are located near the middle section of the support member 350 facilitate the movement of transporter 354 while keeping contact with the transported banknote. Alternatively, the pulleys 358 which were located in the middle section of the support member 350 can be deleted. One of the pulley unit 352 is pulleys is located at a receiving slot 364 which is located at a side wall 362 of the storing unit 316 as shown in FIG. 12.

Figure 10:
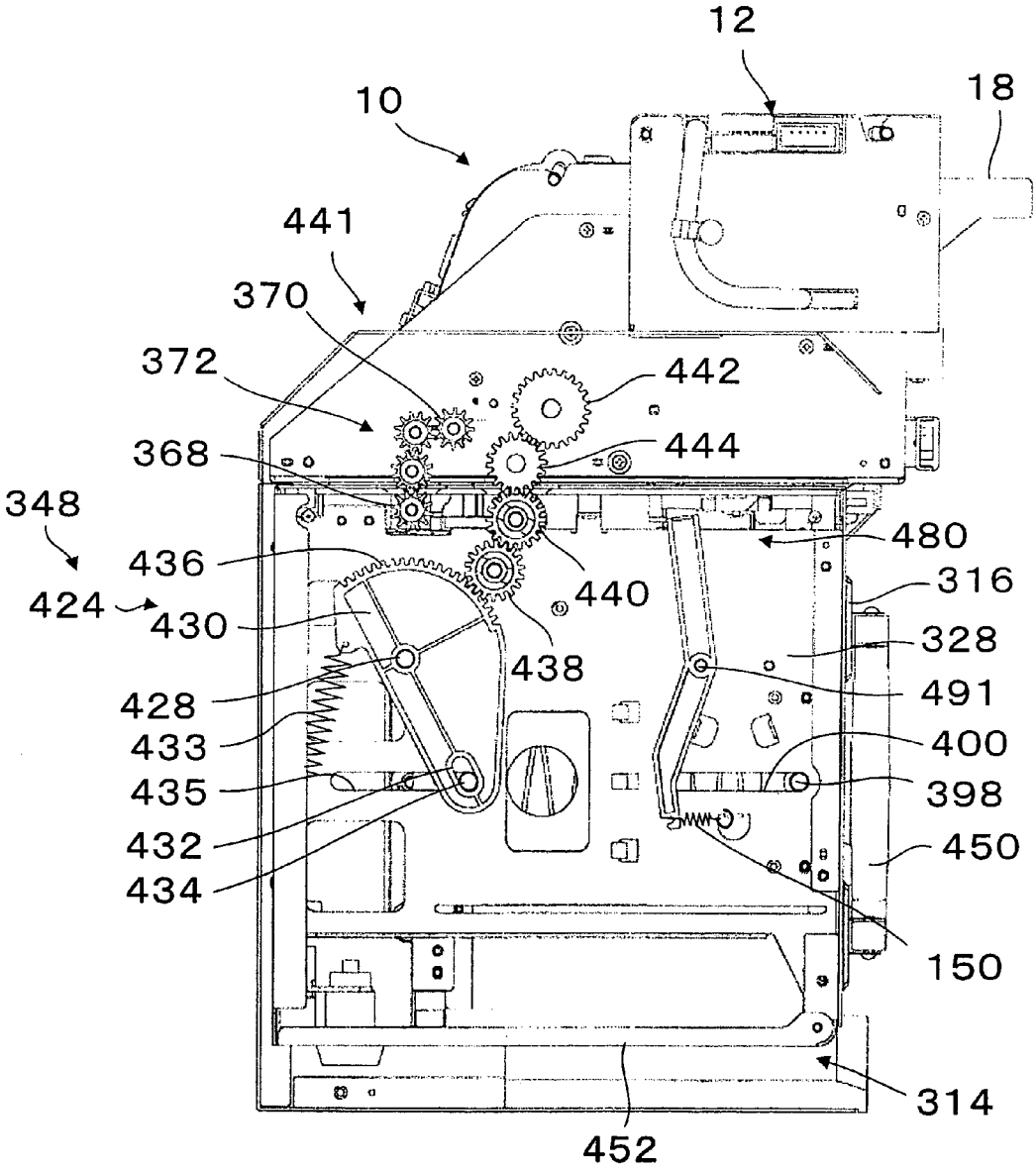
FIG. 10 is a cross sectional view of the banknote receiving unit in accordance with an embodiment of the present invention.
Figure 11:
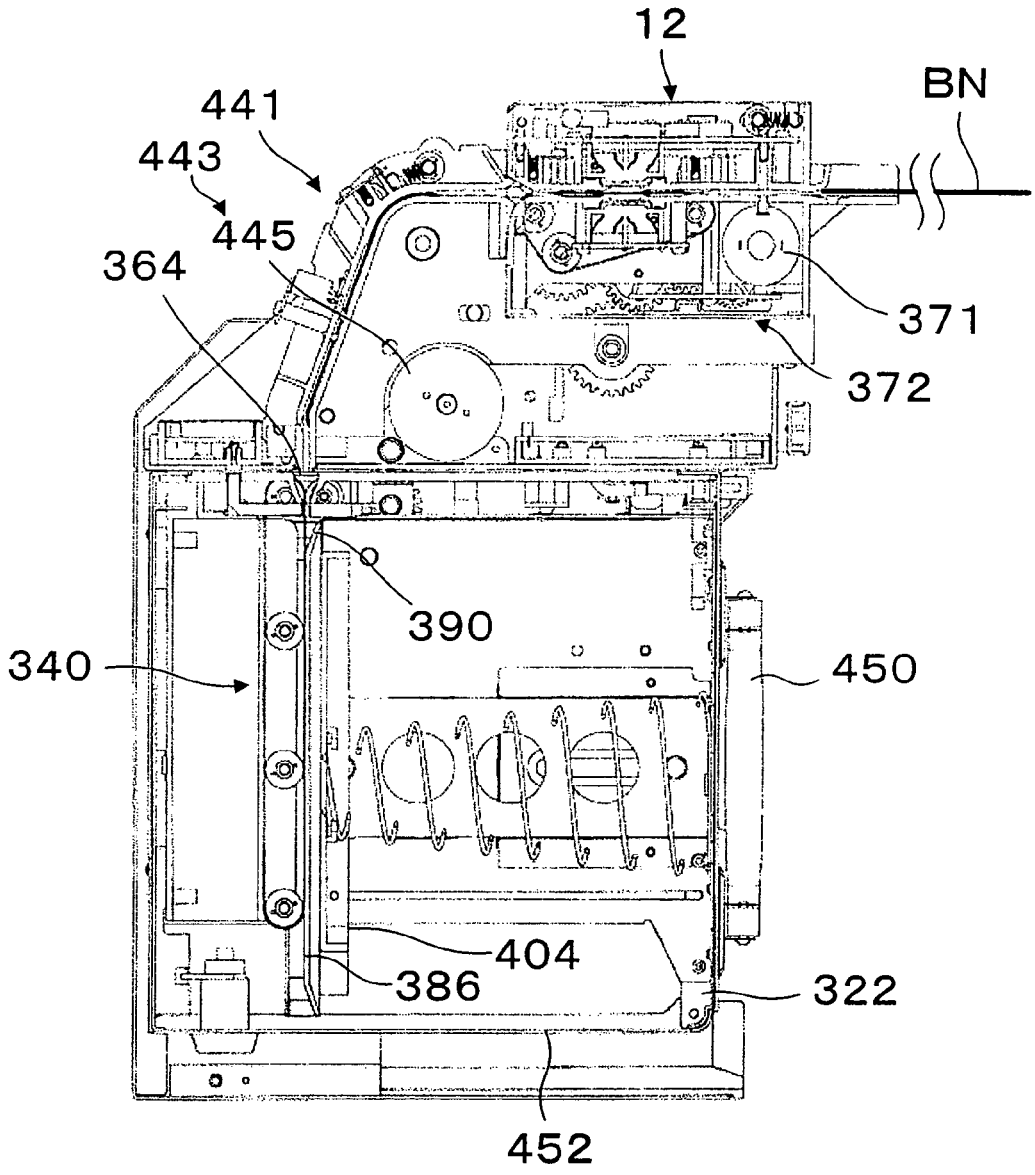
FIG. 11 is a cross sectional view of the banknote moving unit in accordance with an embodiment of the present invention.

The driven gear 368 is attached to the end of shaft 366 as shown in FIG. 14, and is operatively connected to a driving gear 370 which is driven by the rotating driving unit; for example driving motor 371 as shown in FIG. 11, and for driving the banknote accepting unit 12 through a transporting unit 372 as shown in FIG. 10. The transporter 354 is typically a belt with teeth in this embodiment, however it can be changed to a ring which can be made of elastomer, for example, or a plain belt or rope.

As described, the transporter 354 has a function which transports the banknote in a predetermined direction. The transporting section 360 is the contacting section to a banknote for transporter 354. A pair of rollers 374 have elastic contact with transporter 354 which is around the pulley unit 352.

A genuine banknote is distinguished by the banknote accepting unit 12, and is transported towards the receiving slot 364 where the banknote is held between the transporter 354 and the roller 374 before being transported in the transporting direction of transporting section. The genuine banknote is drawn into the storing unit 316, and is transported towards the moving direction of transporting section 360 by friction.

The transporting unit 340 is typically located at both sides of the support member 350 as shown in FIG. 13 so that the banknote is moved along its length due to the high frictional force between the banknote and the transporting section 360. Also, the friction keeps the banknote properly oriented. The transporting unit 340 has a function which draws the received banknote into the storing unit 316 and can be changed to another type of unit which has the same function.

In reference to FIGS. 13–14, the mover unit 344 is described. The mover The mover unit 344 includes a left mover 378 and a right mover 380 which are channel-like in shape and are located beside the transporting unit 340 on the left and the right sides. The left mover 378 and the right mover 380 are similar and symmetrical, so the left mover 378 is explained for convenience. The left mover 378 is T-like in shape and includes a slider section 382 and a first keeping section 384 which is located at an end of the slider section 382, and extends at an angle to the slider section 382.

The first keeping section 382 is bent at a right angle to the slider section 382 and is parallel with the base 326. Hence, the first keeping section 384 is approximately parallel to the drawn banknote. A second keeping section 386 is a plate and is fixed at the slider section 382 and is located below and at a predetermined distance from the first keeping section 384. A left keeping section 388 is enclosed by three sides of a rear surface 383 of the first keeping section 384, an upper surface 385 of the second keeping section 386 and a side surface 387 of the slider section 382, and has a predetermined width and height as shown in FIG. 13. The height of the left keeping section 388 is small and it is desirable to maintain a compact profile for the banknote storing unit 316.

The left keeping section 388 can be made from a resin together with the slider section 382. In this situation, it is F-like in shape. The second keeping section 386 has a predetermined thickness, because when the banknote is bent by transporting unit 340, the banknote no longer has firm contact with the second keeping section 386. A section of the second keeping section 386 to the side of the receiving slot 364 is a slanting surface 390 for guiding the banknote to the left keeping section 388 as shown in FIG. 11. The right keeping section 392 is similar and is located at the right mover 380.

The slider section 382 can slide in the longitudinal direction in the groove 396 of the guide section 394 which can be made of a resin and can be fixed at the inside surface of the left side wall 328. It is preferably located in the groove 396 of the guiding section 394 which is fixed at the left side wall 330 as shown in FIG. 14. Also, a guiding pin 398 protrudes outwards from the lower section of the slider section 382 and is slidable in an elongated hole 400 which is located at the right side wall 330 as shown in FIG. 10 which is similar on the left side. Therefore, the left mover 378 and the right mover 380 are guided by the elongated hole 400 and linearly reciprocate. That is, they move back and forth along the line defined by the elongated hole 400.

When the storing unit 316 is a standby (inactive) condition, the right keeping section 392 of the right mover 380 is located on the extending line of the receiving slot 364 as shown in FIG. 11. The left mover 378 is similarly located. Therefore, the left keeping section 388 and the right keeping section 392 are located in a virtual plane 393 which extends from the receiving slot 364 as shown in FIG. 14. Also the left end and right end of the banknote which is moved by the transporting unit 340 moves into the left keeping section 388 and the right keeping section 392. In one embodiment, the virtual plane 393 is approximately perpendicular, when the banknote moves in virtual plane 393, and the banknote is drawn by gravity as shown in FIG. 11.

When a sensor (not shown) detects the trailing end of the drawn banknote at roller 374, the motor 371 is stopped and the transporting of the banknote is stopped. Therefore the banknote is stopped in the condition where the left and right ends of the banknote is located at left keeping section 388 and right keeping section 392, respectively, at the same time. As a result, the virtual plane 393 is a temporary storing section 395. Also, the left mover 378 and the right mover 380 can move at a right angle to the virtual plane 393.

Therefore, the mover unit 344 can move to a moved position MM which is located near side of left upper plate 332 and right upper plate 334 as shown by the dotted line in FIG. 13. In this way, both end sections of the banknote can be located at the side of a banknote holder 404 rather than simply the left rear surface 406 and the right rear surface 408 of the second keeping section 386. The transporting section 360 is located approximately on the extended line of the upper surface 385 of the second keeping section 386. Therefore the banknote inside storing box 316 is drawn into the storing unit by the friction of the transporting section 360.

Further, the banknote receives the transporting force at the surface, and the other end receives resistance from upper surface 385 of second keeping section 386. The resistance is decided by the contacting area, the contacting pressure and friction rate between the banknote and second keeping section 386. The transporting section 360 which has contact with the banknote is installed in the relaxing side, and when transporting section 360 stops, the upper surface 385 is located approximately on the extended line of the second keeping section 386. Therefore, when the transporting section 360 moves, the transporting section 360 relaxes, and it moves slightly to the side of the second keeping section 360. As a result, the contacting pressure between the banknote and the transporting section 360 is increased to an effective level, and the motivation for adjusting the position of the transporting section is easy to understand. Also, the contacting surface of the transporter 354 is preferably made of urethane rubber since it has a suitable coefficient of friction and acceptable durability. The mover unit 344 has a function where the banknote which is drawn into storing unit 316 by the transporting unit 340 and is moved to the storing section 342. Therefore it can be changed to another type of unit which has the same function.

In reference to FIG. 13, the holding unit 346 is described. The holding unit 346 includes a banknote holder 404 which has contact with the banknote and an urging member 410 which urges the banknote holder 404 toward both the left rear surface 406 and the right rear surface 408 of the second keeping section 386. The banknote holder 404 is a plate and can move between the left and right slider sections 382.

The urging member 410 is preferably a spring 412, and an end of the urging member 410 is fixed at the base 326 while the other end is fixed at the banknote holder 404. The urging force of the urging member 410 is determined so as to reduce the thickness of piled up banknotes and for holding the unbent banknotes like unbent when both the left and right ends of the banknote, which is sandwiched between transporting unit 340 and the banknotes, are moved by mover unit 344, for the banknote is not drawn together. Therefore, the urging member 410 can be changed to an other type of unit that has the same function. Also, the storing section 342 is a space which is enclosed by the left rear surface 406, the right rear surface 408, the transporting section 360, and the banknote holder 404. Therefore when the banknote is not stored, the banknote holder 404 has contact with the left rear surface 406 and the right rear surface 408.

In reference to FIGS. 10 and 14, the structure of the driving unit 348 is described. The driving unit 348 includes a left driving unit 424 and a right driving unit 426 which are attached at the left side wall 328 and right side wall 330, respectively. The left driving unit 424 and right driving unit 426 are the same structure, therefore left driving unit 424 is explained on behalf of the driving units. The same section of right driving unit 426 is attached to the same number.

A pivotable lever 430 can pivot at a fixed shaft 428 which protrudes into the driving space 347 from the left side wall 328. Pin 434 which protrudes from sliding section 382 is inserted into an elongated hole 432 which is located at the end section of the left side wall 328, and it is slidable. Pin 434 is guided by an elongated hole 435 of the left side wall 328.

A sector gear 436 is located at another section of the pivotable lever 430 and is centered on the fixed shaft 428. Sector gear 436 connects with the rotating driving unit 443; for example an electrical motor 445, as shown in FIG. 11, through gears (438, 440) which are attached at the left side wall 328 and are rotatable. In other words, when the storing unit 316 is installed into the safe space 314, gears 440 and 444 are engaged. Therefore, when gear 442 rotates in the clockwise direction, the pivotable lever 430 pivots in the same direction as shown in FIG. 10. The mover unit 344 moves in the banknote storing direction and goes to the moved position MM in a reciprocating manner.

When the gear 442 rotates in the counterclockwise direction, the pivotable lever 430 pivots in the same direction shown in FIG. 10. Also the mover unit 344 moves to the standby position SB. The pivotable lever 430 is urged towards a direction where the moved unit 344 moves towards the standby position SB by a spring 433 which is hooked to piece 431 which protrudes from left side wall 328 to maintain the engagement between the sector gear 436 and the gear 438. The sector gear 436 forms a portion of the pivotable lever 430 as shown in FIG. 10.

The driving unit has a function where the mover unit 344 is reciprocated in a right angle direction to the virtual plain 393 or the surface of the banknote. Therefore, the driving unit 348 can be changed to another type of unit which has the same function. Also, the handle 450 for transporting the storing unit 316 is attached at the outer surface of the base 326. As shown in FIG. 10, an end section of the side wall 452 which faces to the side wall 362 of the storing unit 316 can pivot at the frame 322, and can be either opened or closed for removing or securely locking the stored banknotes.

Figure 15:
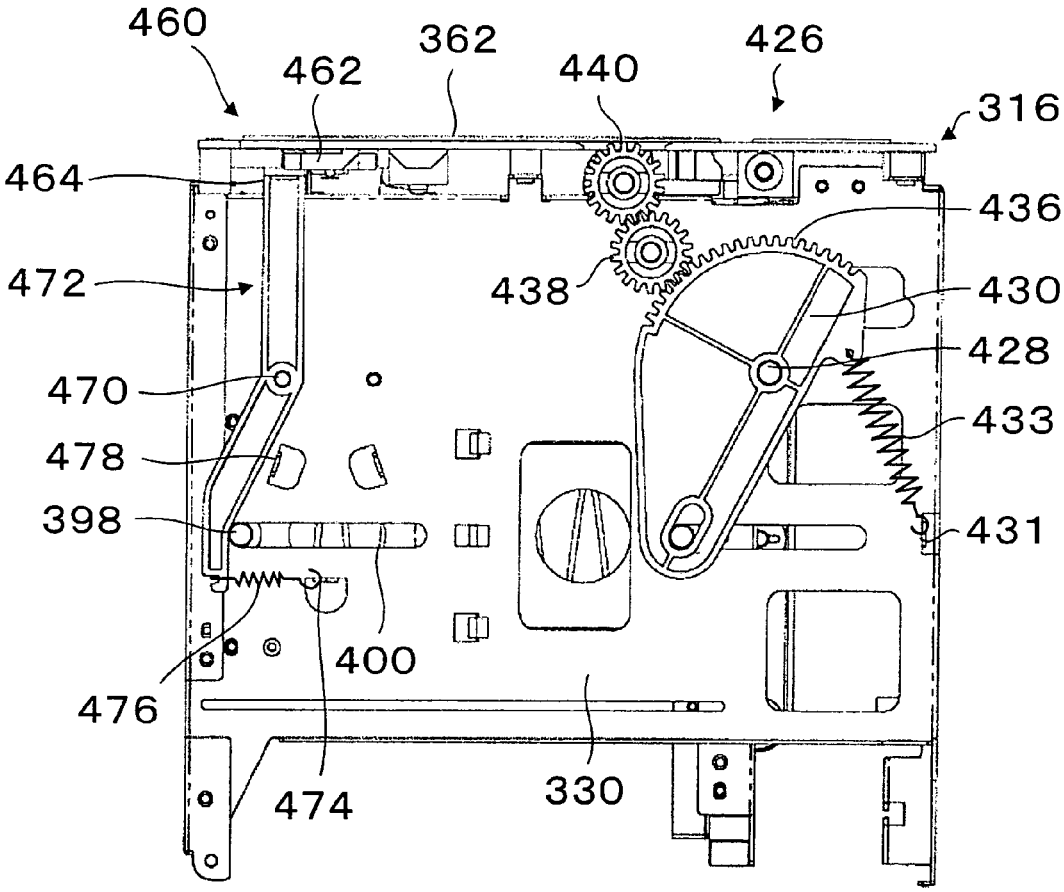
FIG. 15 is a front plan view of the moving unit at a standby condition in accordance with an embodiment of the present invention.

In reference to FIG. 15, a standby position detecting unit 460 of the mover unit 344 is described. The standby position detecting unit 460 includes a standby projecting and receiving light section, a standby optical guide 462, and a standby detecting piece 464 which are similar to the first embodiment. As previously described, the standby projecting and receiving section is located at the upper inside surface of the safe space 314 of the banknote receiving unit 10.

The standby optical guide 462 is gate-like in shape similar to the first embodiment and faces to the standby projecting and receiving section and is affixed at the rear of the side wall 426 of the storing unit 316 by a bracket (not shown). Both the receiving surface 466 and the projecting surface 468 of the standby optical guide 462 are located on the surface of the side wall 362.

The standby detecting piece 464 is an end of lever 472 which is pivotable in the middle section on a fixed shaft 470 at the right side wall 330. The standby detecting piece 464 is urged towards the outside of the detecting space (not shown) of the standby optical guide unit 462 by a spring 476 which is hooked between the other end and the piece 474 which protrudes from the right side wall 330.

Another end of the lever 472 is located in the moving passageway of a pin 398. When the mover unit 344 is located at the standby position SB, the lever 472 is moved by pin 398, and the standby detecting piece 464 is located in the detecting space of the standby optical guide unit 462 as shown in FIG. 15, and it cuts off the light. In this situation, it detects the standby condition of the mover unit 344.

Figure 16:
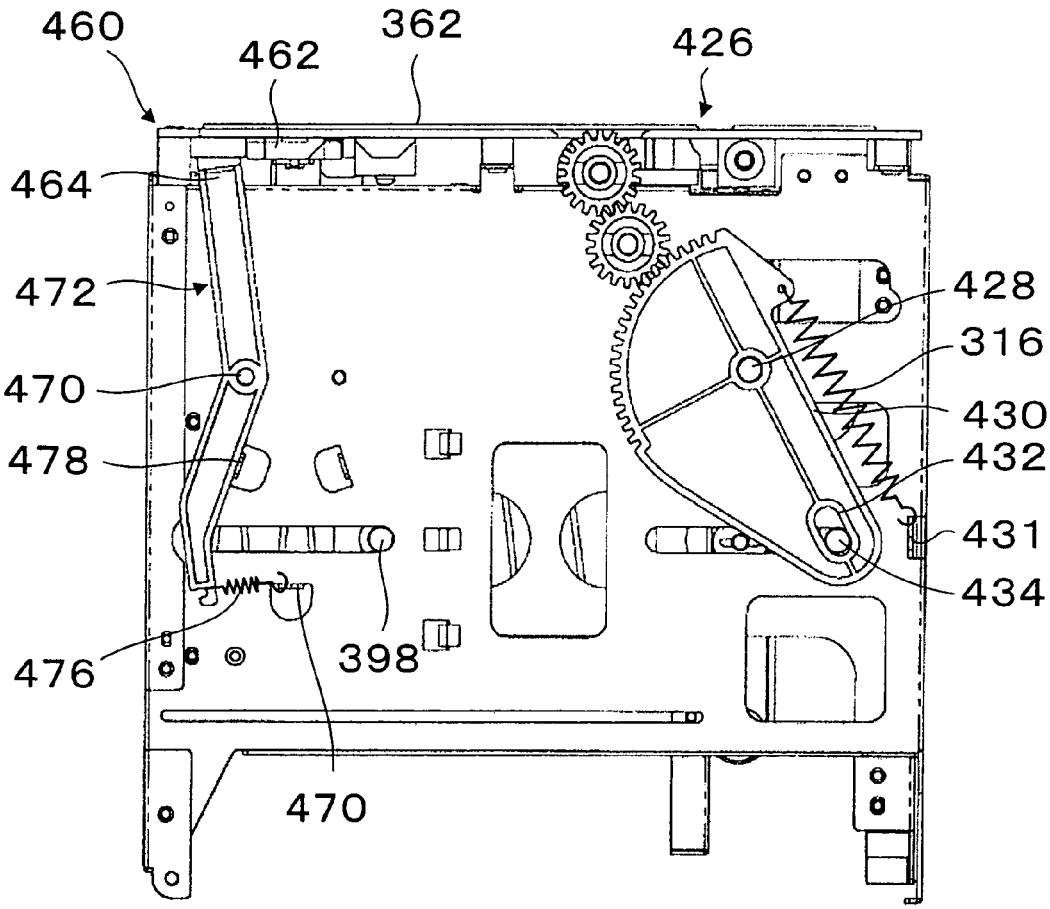
FIG. 16 is a front plan view of the moving unit at a storing condition in accordance with an embodiment of the present invention.

When the mover unit 344 moves towards the moved position MM, the lever 472 pivots in the counter clockwise direction under the force of a spring 476 as shown in FIG. 15. Also the lever 472 is stopped at a predetermined position which is at the outside of the detecting space of the standby optical guide unit 462 by a stopper 478 which protrudes from the right side wall 330 as shown in FIG. 16. When the standby position of the mover unit 344 is detected, the motor 443 is stopped and, therefore, the driving gear 442 is stopped. Thus, the mover unit 344 is maintained in the standby position.

Figure 17:
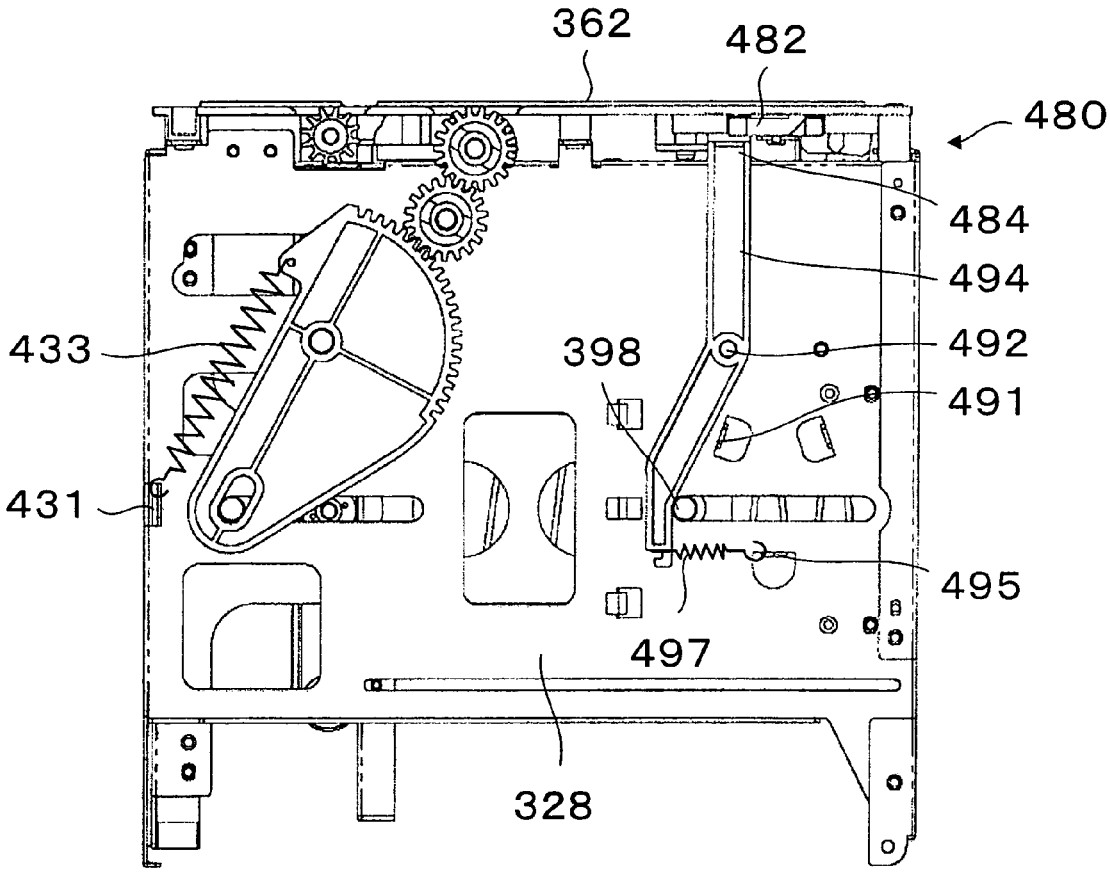
FIG. 17 is a rear plan view of the moving unit at a storing condition in accordance with an embodiment of the present invention.

In reference to FIGS. 10 and 17, the moved position detecting unit 480 is described. The moved position detecting unit 480 includes a moved projecting and receiving section (not shown), a moved optical guide unit 482, and a moved detecting piece 484. The moved projecting and receiving section is the same as the first embodiment. The moved position optical guide unit 482 is located to face the moved projecting and receiving section and is affixed at the rear of the side wall 362 by a bracket (not shown).

The moved optical guide unit 482 is gate-like in shape similar to the first embodiment, and includes a moved detecting space 486 as shown in FIG. 14. Both the moved receiving surface 488 and the moved projecting surface 490 are located on the surface of the side wall 362. The moved detecting piece 484 is an end of the lever 494 which is pivotable at the shaft 492 and which protrudes into the driving unit space 347 from the left side wall 328.

The moved detecting piece 484 of the lever 494 is urged toward the outside of the detecting space 486 of the moved optical guide unit 482 by a spring 497 which is hooked at a piece 495 which protrudes from the left side wall 328. When the mover unit 344 is located at the moved position MM, another end of the lever 494 is moved in the clockwise direction as shown in FIG. 17 by the guiding pin 398 so that the moved detecting piece 484 is located at the detecting space to block the light from passing.

When the moved receiving surface 488 does not receive the light, it detects the condition that the mover unit 344 is located at the moved position MM. When the mover unit 344 is detected at the moved position, the motor 443 and the driving gear 442 stops rotation in the clockwise direction, and then it rotates in the counter clockwise direction. Therefore the mover unit 344 moves from the moved position MM to the standby position SB. When the mover unit 344 is located at the standby position SB, the lever 494 is stopped by a stopper 491 which protrudes from the left side wall 328 and the moved detecting piece 484 does not enter the detecting space 486.

The optical guide unit 496 for detecting the banknote storing unit 316 and banknote optical guide 498, 500 of the banknote position detecting unit are located at the surface of the side wall 362. This second embodiment is controlled similar to the first embodiment by a controlling unit 216 which is preferably a suitably programmed microprocessor running a program shown as a flow diagram in FIG. 9. The operation of the second embodiment is described below.

The storing unit 316 is installed or positioned within the banknote receiving unit 10 at a predetermined position in the safe space 314, so that the gear 440 properly engages with the gear 444. After properly installing the storing unit 316, the banknote receiving unit 10 is energized by turning "on" an electrical switch (not shown). When the mover unit 344 is not detected at the standby position SB by the standby position detecting unit 460, the built-in controlling unit operates the motor 443 to rotate, which causes the gear 442 rotates in the counter clockwise direction shown in FIG. 10. Also, the pivotable lever 430 rotates in the counter clockwise direction.

Therefore, the mover unit 344 moves towards the right as shown in FIG. 10 through pin 434 and slider section 382, and moves to the standby position SB. When the mover unit 344 is located at the standby position SB, the lever 472 pivots in the clockwise direction by pin 398 as shown in FIG. 15. Therefore, the standby detecting piece 464 goes into the detecting space of the standby optical guide unit 462, and it cuts off the detecting light, and is detected by the standby position detecting unit 460. The motor 443 stops, and gear 442 stops to remain in the standby condition based on this detection.

In the standby condition, the left keeping section 388 and the right keeping section 392 both of left mover 378 and right mover 380 are located under the receiving slot 364, and are approximately perpendicular as shown in FIG. 11. When the banknote BN is inserted along a banknote guide 18, the banknote BN is detected by a sensor (not shown), and the transporting motor 371 begins to rotate.

The transporting unit (not shown) of the banknote accepting unit 12 operates by the rotation of the transporting motor 371, also, the driven gear 368 is rotated through the driving gear 370 and transmitting mechanism 372. Therefore the shaft 366 is rotated, and the transporting unit 340 starts the drawing in motion which draws the banknote BN to a temporary storing section 395. If the banknote BN is determined to be genuine by the banknote accepting unit 12, the received banknote BN is transported to the receiving slot 364. The end of the banknote BN is held between the transporter 364 and roller 374.

Therefore, the banknote BN is transported into the temporary storing section 395 by the transporter 354 and the roller 374, and is drawn into the temporary storing section 395 by the transporter 354. As a result, the banknote BN does not jam in the mechanism. In this time, the transporting section 360 which has contact with the banknote BN of the transporter 354 is has one side relaxed.

In other words, the transporting section 360 slightly relaxes, because the transporting section 360 is on the relaxing side of the transporter 354. Therefore the contacting pressure between the banknote BN and the transporting section 360 increases to an effective level because the position of the transporting section 360 moves to the side of the second keeping section 386. As a result, the friction force between transporting section 360 and the banknote BN is sufficient. Also, the transporting section 360 can suit the flexibility of banknote the BN, and banknote the BN is not damaged.

The left end section of the moving banknote BN is located in the left keeping section 388 and is guided by the lower surface 383 of the first keeping section 384, the upper surface 385 of second keeping section 388, and the side surface 387 of the slider 382. The left end section of the banknote BN does not go into an opening, because it is enclosed on three sides. On the other hand, the right end section of the banknote BN moves in the right keeping section 392 of the left mover 380. When the width differs based on denomination, the right end section of the narrow banknote is guided by the lower surface 383 of the first keeping section 384 and the upper surface 385 of the right keeping section 392.

In this case, the banknote lengths which are located at both left and right of transporting unit 340 can differ and the contact area to both the first keeping section 384 and the second keeping section 386 can differ. Therefore, the banknote BN receives a rotating force. However, the left end section is guided by the side surface 387 of the sliding section 382. Therefore, the banknote BN does not move in a slanting condition to the moving direction. When the rear section of the banknote BN passes through the roller 374, immediately after it is detected by the banknote position detecting unit and the motor 371 stops.

At this point, the received banknote BN is temporarily stored in a temporary storing section 395. The motor 445 and gear the 442 rotate in the clockwise direction. Therefore, the pivotable lever 430 pivots in the clockwise direction at the center around a fixed shaft 428 as shown in FIG. 10 through the sector gear 436. Therefore, the slider section 382 moves in the left direction as shown in FIG. 10 through the pin 434.

The guiding pin 398 is guided by an elongated hole 400 and the pin 434 is guided by the elongated hole 435. Therefore, the slider section 382 moves in right angle direction to the temporary storing section 395. The left mover 378 and the right mover 380 move together, and they pass through the side of the transporting unit 340 along the support member 350. In this process, the middle of the banknote BN is held with a predetermined force by the transporting unit 340 and banknote holder 404.

Also, the left mover 378 and the right mover 380 move towards the left upper plate 332 and the right upper plate 334. Therefore the left and right end sections of the banknote BN move relatively to the left mover 378 and the right mover 380. In this process, the right side end of the banknote BN, which is shorter, extends outside of the second keeping section 386 of the right mover 380.

The left mover 378 and the right mover 380 move to the moved position MM which is near to the left upper plate 332 and the right upper plate 334. Therefore, the left end section of the banknote BN goes to the outside of the second keeping section 386 of the left mover 378 as shown in FIG. 13. When the width of banknote is the widest allowable, the left and right end sections go out roughly at the same time from the left mover 378 or the right mover 380. Therefore, the banknote BN moves into the storing section 342.

When the mover unit 344 moves to the moved position MM, the lever 494 is pivoted in the clockwise direction by pin 398 as shown in FIG. 17. Therefore the moved detecting piece 484 moves into the moved detecting space 486 of the moved optical guide unit 482, and it cuts off the detecting light. Accordingly, the motor 445 stops, and is then reversed, and gear 442 is rotated in the counter clockwise direction as shown in FIG. 10.

Therefore, the pivotable lever 430 pivots in the counter clockwise direction as shown in FIG. 17 and moves to the standby position SB shown in FIG. 10. The mover unit 344 moves from the moved position MM to the standby position shown in FIG. 13 by the pivoting motion of the pivotable lever 430. Therefore, the moved banknote BN in the storing section 342 is held by the left rear surface 406, the right rear surface 408, and the banknote holder 404.

In addition, the descriptive words such as up, down, left, and right are used for a user's convenience, and are not considered limiting. The present invention may be practiced with the claimed apparatus oriented differently than as shown in the drawings. Therefore the present invention is not limited by the words. Also, the standby position detecting unit 126 and moving position detecting unit 176 can detect the position of another unit; such as the sector gear 108, for example.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A banknote moving system, comprising:

a banknote storing unit for being removably positioned within a banknote receiving unit, the banknote storing unit having a storing section and receiving a banknote from the banknote receiving unit;

a mover unit for moving the received banknote into the storing section of the storing unit, the mover unit moving between a standby position and a moved position;

a mover driving unit for operating the mover unit in a reciprocating manner between the standby position and the moved position;

a rotating driving unit for selectively operating the mover driving unit by applying a rotating force in one of a clockwise direction and a counter clockwise direction;

a standby position detecting unit for producing a standby condition signal when the mover unit is in a standby condition;

a moved position detecting unit for producing a moved position condition signal when the mover unit is in a moved position condition;

a controlling unit for receiving the standby condition signal and the moved position condition signal and producing a driving direction command signal for selectively operating the rotating driving unit in one of a clockwise direction and a counter clockwise direction;

a pivotable lever for operating the mover unit in a reciprocating manner;

a pivoting shaft having a first end and a second end, the pivotable lever being mounted on the first end of the pivoting shaft; and a sector gear being mounted on the second end of the pivoting shaft, the sector gear being engaged with the rotating driving unit and driven in one of a clockwise direction and a counter clockwise direction to impart reciprocating motion to the mover unit.

2. A banknote moving system, comprising:

a banknote receiving unit for receiving a banknote;

a banknote storing unit for being removably positioned within the banknote receiving unit, the banknote storing unit having a storing section and receiving the banknote from the banknote receiving unit;

a mover unit for moving the received banknote into the storing section of the storing unit, the mover unit moving between a standby position and a moved position;

a mover driving unit for operating the mover unit in a reciprocating manner between the standby position and the mover position;

a rotating driving unit for selectively operating the mover driving unit by applying a rotating force in one of a clockwise direction and a counter clockwise direction;

a standby position detecting unit for producing a standby condition signal when the mover unit is in a standby condition;

a moved position detecting unit for producing a moved position condition signal when the mover unit is in a moved position condition; and a controlling unit for receiving the standby condition signal and the moved position condition signal and producing a driving direction command signal for selectively operating the rotating driving unit in one of a clockwise direction and a counter clockwise direction;

wherein the mover unit is disposed within the banknote storing unit, the rotating driving unit is disposed within the banknote receiving unit, and the mover driving unit includes a plurality of mover driving unit gears for conducting rotational force between the rotating driving unit and the mover unit, a predetermined portion of the plurality of mover driving unit gears are disposed within the banknote storing unit.

3. The banknote moving system of claim 2, the mover unit further comprising:

a left mover disposed adjacent to a moving passageway; and a right mover disposed adjacent to the moving passageway and opposite from the left mover, wherein the left mover and the right mover cooperate to move the received banknote along a pushing passageway into the storing section.

4. The banknote moving system of claim 2, wherein the rotating driving unit is an electric motor.

5. The banknote moving system of claim 2, wherein the plurality of mover driving unit gears conduct rotational force between the rotating driving unit and the mover unit when the banknote storing unit is positioned within the banknote receiving unit.

6. A banknote moving system, comprising:

a banknote storing unit for being removably positioned within a banknote receiving unit, the banknote storing unit having a storing section and receiving a banknote from the banknote receiving unit;

a mover unit for moving the received banknote into the storing section of the storing unit, the mover unit moving between a standby position and a moved position;

a mover driving unit for operating the mover unit in a reciprocating manner between the standby position and the mover position;

a rotating driving unit for selectively operating the mover driving unit by applying a rotating force in one of a clockwise direction and a counter clockwise direction;

a standby position detecting unit for producing a standby condition signal when the mover unit is in a standby condition;

a moved position detecting unit for producing a moved position condition signal when the mover unit is in a moved position condition;

a controlling unit for receiving the standby condition signal and the moved position condition signal and producing a driving direction command signal for selectively operating the rotating driving unit in one of a clockwise direction and a counter clockwise direction;

a pivotable lever having a sector gear portion, the pivotable lever being pivotable at a shaft located at a surface of the banknote storing unit and operatively connected with the mover unit, and wherein the sector gear portion engages with the rotating driving unit for reciprocating the mover unit.

7. A banknote moving system, comprising:

a banknote receiving unit for receiving a banknote;

a banknote storing unit for being removably positioned within the banknote receiving unit, the banknote storing unit having a storing section and receiving the banknote from the banknote receiving unit;

mover means for moving the received banknote into the storing section of the storing unit, the mover means moving between a standby position and a moved position;

a mover driving unit for operating the mover means in a reciprocating manner between the standby position and the moved position;

rotating driving means for selectively operating the mover driving unit by applying a rotating force in one of a clockwise direction and a counter clockwise direction;

a standby position detecting unit for producing a standby condition signal when the mover means is in a standby condition;

a moved position detecting unit for producing a moved position condition signal when the mover unit means in a moved position condition;

a controlling unit for receiving the standby condition signal and the moved position condition signal and producing a driving direction command signal for selectively operating the rotating driving means in one of a clockwise direction and a counter clockwise direction, and wherein the mover means is disposed within the banknote storing unit, the rotating driving means is disposed within the banknote receiving unit, and the mover driving unit includes a plurality of mover driving unit gears for conducting rotational force between the rotating driving means and the mover means, a predetermined portion of the plurality of mover driving unit gears are disposed within the banknote storing unit.

8. The banknote moving system of claim 7, the mover means further comprising:

a left mover disposed adjacent to a moving passageway; and a right mover disposed adjacent to the moving passageway and opposite from the left mover, wherein the left mover and the right mover cooperate to move the received banknote along a pushing passageway into the storing section.

9. The banknote moving system of claim 7, wherein the rotating driving means is an electric motor.

10. The banknote moving system of claim 7, wherein the plurality of mover driving unit gears conduct rotational force between the rotating driving means and the mover means when the banknote storing unit is positioned within the banknote receiving unit.

11. A banknote moving system, comprising:

a banknote storing unit for being removably positioned within a banknote receiving unit, the banknote storing unit having a storing section and receiving a banknote from the banknote receiving unit;

a mover unit for moving the received banknote into the storing section of the storing unit, the mover unit moving between a standby position and a moved position;

a mover driving unit for operating the mover unit in a reciprocating manner between the standby position and the mover position;

a rotating driving unit for selectively operating the mover driving unit by applying a rotating force in one of a clockwise direction and a counter clockwise direction;

a standby position detecting unit for producing a standby condition signal when the mover unit is in a standby condition;

a moved position detecting unit for producing a moved position condition signal when the mover unit is in a moved position condition; and a controlling unit for receiving the standby condition signal and the moved position condition signal and producing a driving direction command signal for selectively operating the rotating driving unit in one of a clockwise direction and a counter clockwise direction, wherein the standby position detecting unit includes a light-emitting element, a photo acceptance element with parallel optical axis and an optical guide unit that reverses the direction of light from the light-emitting element to the photo acceptance element, and wherein the optical guide unit includes a gap detecting space and the mover unit includes a pusher member with a portion that enters the gap detecting space in a standby position.

* * * * *